US007198534B2

(12) United States Patent
Takahashi et al.

(10) Patent No.: US 7,198,534 B2
(45) Date of Patent: Apr. 3, 2007

(54) METHOD FOR MANUFACTURING HIGH-PRESSURE DISCHARGE LAMP, GLASS TUBE FOR HIGH-PRESSURE DISCHARGE LAMP, AND LAMP ELEMENT FOR HIGH-PRESSURE DISCHARGE LAMP

(75) Inventors: Kiyoshi Takahashi, Kyoto (JP); Makoto Horiuchi, Nara (JP); Tsuyoshi Ichibakase, Osaka (JP); Shinichiro Hataoka, Osaka (JP); Tomoyuki Seki, Osaka (JP); Takashi Tsutatani, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 325 days.

(21) Appl. No.: 10/760,166

(22) Filed: Jan. 19, 2004

(65) Prior Publication Data

US 2004/0150343 A1 Aug. 5, 2004

(30) Foreign Application Priority Data

Jan. 24, 2003 (JP) ..... 2003-016346

(51) Int. Cl.
*H01J 9/00* (2006.01)

(52) U.S. Cl. ..... 445/26; 445/22; 445/27; 445/43; 313/623; 313/634

(58) Field of Classification Search ..... 445/26, 445/22, 27, 43; 313/579, 623, 634
See application file for complete search history.

(56) References Cited

U.S. PATENT DOCUMENTS 4,412,963 A * 11/1983 Hing ..... 156/89.12
5,109,181 A 4/1992 Fischer et al.
6,232,719 B1 5/2001 Kaneko et al.
6,890,236 B2 * 5/2005 Hataoka et al. ..... 445/26

FOREIGN PATENT DOCUMENTS

| | | |
|---|---|---|
| EP | 1 225 614 A1 | 7/2002 |
| JP | 2-148561 | 6/1990 |
| JP | 4-229942 | 8/1992 |
| JP | 2001-23570 | 1/2001 |

* cited by examiner

*Primary Examiner*—Karabi Guharay
*Assistant Examiner*—Anthony Canning
(74) *Attorney, Agent, or Firm*—Harness, Dickey & Pierce, P.L.C.

(57) ABSTRACT

A method for manufacturing a high-pressure discharge lamp includes a process step in which a sealing portion is formed out of a side tube portion of a glass pipe that is designed for use in a discharge lamp. In the step of forming the sealing portion, a compound glass tube, which is composed of an outer tube made of a first glass and an inner tube made of a second glass whose softening point is lower than that of the first glass, is inserted into the side tube portion, which is also formed of the first glass. The side tube portion is then heated so that the side tube portion is brought in tight contact with the compound glass tube. Thereafter, at least the sealing portion is heated at a temperature higher than the strain point temperature of the second glass portion.

18 Claims, 20 Drawing Sheets

Compressive stress remains

METHOD FOR MANUFACTURING HIGH-PRESSURE DISCHARGE LAMP, GLASS TUBE FOR HIGH-PRESSURE DISCHARGE LAMP, AND LAMP ELEMENT FOR HIGH-PRESSURE DISCHARGE LAMP

BACKGROUND OF THE INVENTION

The present invention relates to glass tubes and lamp elements for use in high-pressure discharge lamps. In particular, the present invention relates to methods for manufacturing high-pressure discharge lamps used in general illumination, in projectors and automobile headlights in combination with a reflecting mirror, or in like applications.

In recent years, image-projecting apparatuses such as liquid crystal projectors and DMD (Digital Micromirror Device) projectors have been widely used as systems for realizing large-scale video images. In such image-projecting apparatuses, high-pressure discharge lamps with high intensity have been commonly used. FIG. 14 is a schematic view illustrating the structure of a conventional high-pressure discharge lamp 1000. The lamp 1000 illustrated in FIG. 14 is a so-called ultrahigh-pressure mercury lamp, which is disclosed, for example, in Japanese Unexamined Patent Publication No. 2-148561.

The lamp 1000 includes a luminous bulb (arc tube) 101 made of quartz glass, and a pair of sealing portions (seal portions) 102 that extend from both ends of the luminous bulb 101. A luminous material (mercury) 106 is enclosed (in a discharge space) inside the luminous bulb 101, and a pair of tungsten electrodes (W electrodes) 103 made of tungsten are opposed to each other at a predetermined distance. The W electrodes 103 are each welded at one end to a respective molybdenum foil (Mo foil) 104 that is provided in each sealing portion 102, so that the W electrodes 103 are electrically connected with the respective Mo foils 104. The Mo foils 104 are each electrically connected at one end to a respective external lead (Mo rod) 105 made of molybdenum. In addition to the mercury 106, argon (Ar) and a small amount of halogen are also enclosed in the luminous bulb 101.

The operational principle of the lamp 1000 will be briefly described below. When a start voltage is applied across the W electrodes 103 via the external leads 105 and the Mo foils 104, discharge of argon (Ar) occurs. This discharge increases the temperature in the discharge space in the luminous bulb 101, thereby heating and evaporating the mercury 106. The resultant mercury atoms are then exited to emit light in the central portion of the arc between the W electrodes 103. The higher the mercury vapor pressure in the lamp 1000 becomes, the more light is radiated, which means that a lamp with a higher mercury vapor pressure is more suitable as a light source of an image-projecting apparatus. However, in view of the physical strength of the luminous bulb 101 against pressure, the lamp 1000 is used at a mercury vapor pressure of from 15 to 20 MPa (150 to 200 atm).

SUMMARY OF THE INVENTION

The conventional lamp 1000 described above is capable of withstanding pressures at the 20 MPa level. In order to further improve the lamp characteristics, research and development aiming to enhance the strength against pressure have been made (e.g., see Japanese Unexamined Patent Publication No. 2001-23570). This is because in realizing higher performance image-projecting apparatuses, lamps with higher output and higher power are needed, which requires those lamps to have higher strength against pressure.

More specifically, to achieve a high-output and high-power lamp, more mercury has to be enclosed, and the lamp voltage made higher, than usual in order to suppress rapid vaporization of the electrodes associated with increases in current. If the amount of mercury enclosed is insufficient relatively to the lamp power, the lamp voltage cannot be increased to a necessary level, resulting in lamp current increases. As a result, the electrodes are evaporated in a shorter time, and a practical lamp cannot be therefore achieved. In other words, what should be done to realize a high output-power lamp is to increase the lamp power and to produce a short arc lamp whose interelectrode distance is shorter than that of the conventional lamp. To that end, it is necessary to improve the strength against pressure so as to increase the amount of mercury enclosed. Nevertheless, current techniques have not yet succeeded in realizing a high-pressure discharge lamp having very high strength against pressure (e.g., about 30 MPa or more) that can be used in practice.

The inventors successfully developed high-pressure discharge lamps having an extremely high strength against pressure (e.g., about 30 MPa or more) as disclosed in Japanese Patent Application No. 2002-351524. However, the inventors have found that even such excellent lamps can be further improved by modifying their manufacturing methods.

The present invention was made in view of the foregoing respects, and it is a main object of the present invention to provide more effective methods for manufacturing high-pressure discharge lamps having high strength against pressure. Another object of the present invention is to provide glass tubes and lamp elements used in high-pressure discharge lamps, which tubes and elements are suitably used in the inventive manufacturing methods.

An inventive method is a method for manufacturing a high-pressure discharge lamp comprising a luminous bulb, in which a luminous substance is enclosed, and a sealing portion for retaining the airtightness of the luminous bulb. The inventive method includes the steps of: (a) preparing a glass pipe designed for use in a discharge lamp, which pipe includes a luminous bulb portion that will be formed into the luminous bulb of the high-pressure discharge lamp, and a side tube portion extending from the luminous bulb portion; and (b) forming the sealing portion from the side tube portion. The sealing-portion formation step (b) includes the steps of: (c) preparing a compound glass tube that includes an outer tube made of a first glass and an inner tube made of a second glass, the outer tube being located in tight contact with the periphery of the inner tube, the second glass having a lower softening point than that of the first glass, the side tube portion being formed of the first glass; (d) inserting the compound glass tube into the side tube portion, and then heating the side tube portion, thereby tightly attaching the side tube portion to the compound glass tube; and (e) heating, after the attachment step (d), a portion including at least the compound glass tube and the side tube portion at a temperature higher than the strain point temperature of the second glass.

In one preferred embodiment, the compound glass tube preparation step (c) includes: inserting the inner tube made of the second glass into the outer tube made of the first glass, and reducing pressure in a gap between the outer and inner tubes, and heating at least the outer tube, thereby bringing the outer and inner tubes in tight contact with each other.

The heating step (e) is preferably performed at a temperature lower than the strain point temperature of the first glass.

In one preferred embodiment, the outer and inner tubes that form the compound glass tube are each composed of a single layer; the first glass forming the outer tube contains 99 wt % or more of $SiO_2$; and the second glass forming the inner tube contains $SiO_2$ and at least one of 15 wt % or less of $Al_2O_3$ and 4 wt % or less of B.

In one preferred embodiment, the inner tube of the compound glass tube has a multilayer structure, while the outer tube thereof is composed of a single layer; the outer tube is made of quartz glass; and at least one of the multiple layers forming the inner tube is a glass layer made of glass which contains $SiO_2$ and at least one of 15 wt % or less of $Al_2O_3$ and 4 wt % or less of B.

Another inventive method is a method for manufacturing a high-pressure discharge lamp comprising a luminous bulb, in which a luminous substance is enclosed, and a pair of sealing portions extending from both ends of the luminous bulb. The inventive method includes the steps of: (a) preparing a glass pipe designed for use in a discharge lamp, which pipe includes a luminous bulb portion that will be formed into the luminous bulb of the high-pressure discharge lamp, and a pair of side tube portions extending from both ends of the luminous bulb portion; and (b) inserting, into one of the pair of side tube portions, a compound glass tube and an electrode structure that includes at least an electrode rod, and then heating the one side tube portion to cause the one side tube portion to shrink, thereby forming one of the pair of sealing portions. The compound glass tube includes an outer tube made of a first glass and an inner tube made of a second glass. The outer tube is located in tight contact with the periphery of the inner tube, the second glass has a lower softening point than that of the first glass, and the side tube portions is formed of the first glass.

In one preferred embodiment, the method further includes the steps of: (c) introducing a luminous substance into the luminous bulb portion, after the one sealing portion has been formed; (d) inserting, after the one sealing portion has been formed, a compound glass tube and an electrode structure that includes at least an electrode rod, into the other of the pair of side tube portions, and then heating the other side tube portion to cause the other side tube portion to shrink, thereby forming the other of the pair of sealing portions. The compound glass tube includes an outer tube made of a first glass and an inner tube made of a second glass. The outer tube is located in tight contact with the periphery of the inner tube, the second glass has a lower softening point than that of the first glass, and the side tube portions is formed of the first glass. The method further includes the step of (e) heating the resultant lamp assembly, in which both the sealing portions and the luminous bulb have been formed, at a temperature higher than the strain point temperature of the second glass but lower than the strain point temperature of the first glass, where the lamp assembly includes at least the compound glass tubes and the side tube portions.

The compound glass tube and the electrode structure may be formed into one body.

The heating step (e) is preferably performed for 2 hours or more.

In one preferred embodiment, the heating step (e) is performed for 100 hours or more.

In one embodiment, the heating is performed by placing the lamp assembly in a furnace at a temperature higher than the strain point temperature of the second glass but lower than the strain point temperature of the first glass. In one embodiment, the furnace is under vacuum or reduced pressure.

In one preferred embodiment, the heating step (e) is performed so that when the sealing portion is measured by a sensitive color plate method utilizing a photoelastic effect, a compressive stress of from 10 $kgf/cm^2$ to 50 $kgf/cm^2$ inclusive extending in the longitudinal direction of the side tube portion is present in the region formed of the second glass.

The compressive stress is preferably generated in each of the pair of sealing portions.

In one preferred embodiment, the electrode structure includes the electrode rod, a metal foil connected to the electrode rod, and an external lead connected to the metal foil; and the compound glass tube is inserted into the side tube portion so that the compound glass tube covers at least the connection portion of the electrode rod and the metal foil.

In one preferred embodiment, the first glass contains 99 wt % or more of $SiO_2$, and the second glass contains $SiO_2$ and at least one of 15 wt % or less of $Al_2O_3$ and 4 wt % or less of B.

In one preferred embodiment, the high-pressure discharge lamp is a high-pressure mercury lamp, and mercury serving as the luminous substance is enclosed in an amount of 150 $mg/cm^3$ or more, which is determined based on the internal volume of the luminous bulb.

An inventive glass tube designed for use in a high-pressure discharge lamp includes: an outer tube made of quartz glass, and an inner tube formed inside and in tight contact with the outer tube. The inner tube is made of glass having a lower softening point than that of the quartz glass.

An inventive lamp element designed for use in a high-pressure discharge lamp includes: an electrode structure including an electrode rod, a metal foil connected to the electrode rod, and an external lead connected to the metal foil; and a glass member formed in tight contact with the electrode structure so that the glass member covers the electrode structure at least where the electrode rod is connected with the metal foil. The glass member has a multilayer structure, a surface layer of the glass member is made of quartz glass, and a layer located inside the surface layer is made of glass having a lower softening point than that of the quartz glass.

An inventive lamp unit includes a high-pressure discharge lamp manufactured by the above-mentioned manufacturing methods, and a reflecting mirror for reflecting light emitted from the high-pressure discharge lamp.

In one embodiment, mercury is enclosed as the luminous substance in an amount of 220 $mg/cm^3$ or more, which is determined based on the internal volume of the luminous bulb.

In one embodiment, mercury is enclosed as the luminous substance in an amount of 300 $mg/cm^3$ or more, which is detrained based on the internal volume of the luminous bulb.

In one embodiment, the luminous bulb is tipless.

In one embodiment, mercuric bromide ($HgBr_2$) is enclosed in the luminous bulb as a halogen precursor which generates halogen when decomposed.

In one embodiment, the electrode structure includes the electrode rod, a metal foil connected to the electrode rod, and an external lead connected to the metal foil.

It is preferable that a metal film made of at least one metal selected from the group consisting of Pt, Ir, Rh, Ru, and Re is formed at least on a portion of the electrode rod.

In one embodiment, a coil having, at least on its surface, at least one metal selected from the group consisting of Pt, Ir, Rh, Ru, and Re is wound around at least a portion of the electrode rod.

In one embodiment, in the glass pipe designed for use in a discharge lamp, the side tube portion has a small-diameter portion near the boundary between the side tube portion and the luminous bulb portion. The inner diameter of the small-diameter portion is made smaller than that of the rest of the side tube portion.

A high-pressure discharge lamp in one embodiment includes a luminous bulb, in which a luminous substance is enclosed, and a sealing portion for retaining the airtightness of the luminous bulb. The sealing portion has a first glass portion extending from the luminous bulb, and a second glass portion provided at least in an inner portion of the first glass portion. When a strain measurement is performed by a sensitive color plate method utilizing a photoelastic effect, compressive stress is observed at least in a portion of a region corresponding to the second glass portion in the sealing portion.

The strain measurement may be performed by using a strain detector of SVP-200 manufactured by Toshiba Cooperation.

BRIEF DESCRIPTION OF THE DRAWINGS

FIG. 5A is a schematic cross-sectional view illustrating a structure of a compound glass tube 170, while

DETAILED DESCRIPTION OF THE PREFERRED EMBODIMENTS

Prior to describing embodiments of the present invention, high-pressure mercury lamps exhibiting an extremely high strength against pressure will be described, which lamps have a lighting operation pressure of from about 30 to 40 MPa or higher (about 300 to 400 atm or higher). The details of these high-pressure mercury lamps as well as mechanism by which strain is created in sealing portions in those lamps are disclosed in U.S Patent Specification No. 2003-0168980-A1, which is used herein for reference purposes.

Figure 1A:
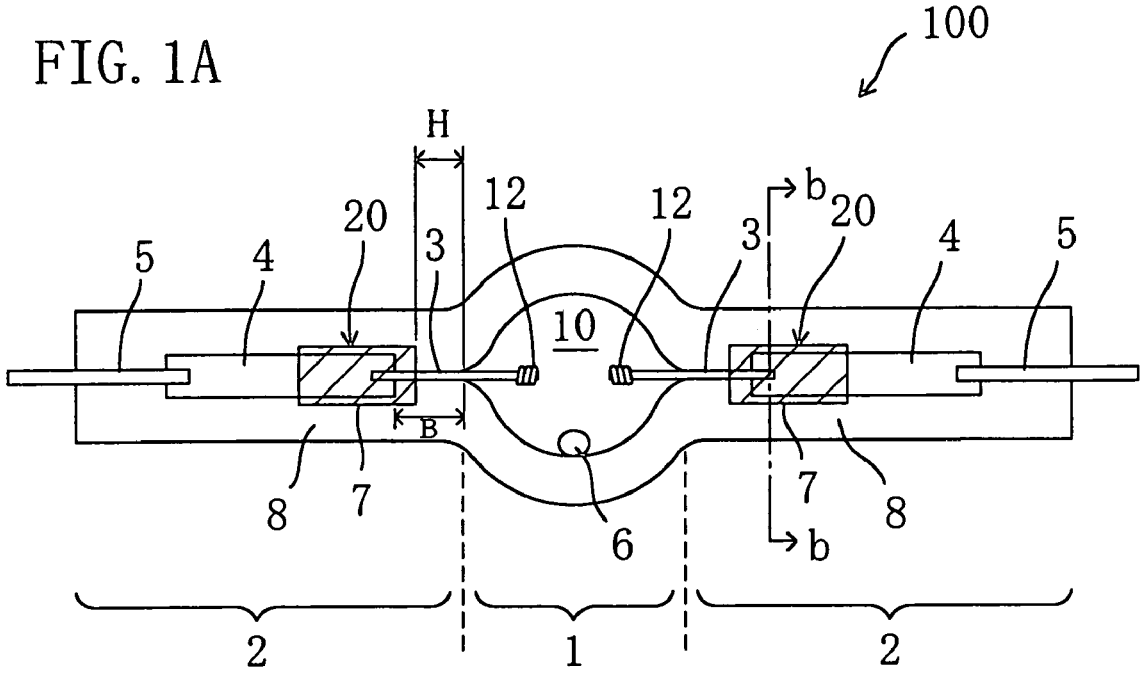
FIGS. 1A and 1B are schematic cross-sectional views illustrating a structure of a high-pressure discharge lamp 100.
Figure 1B:
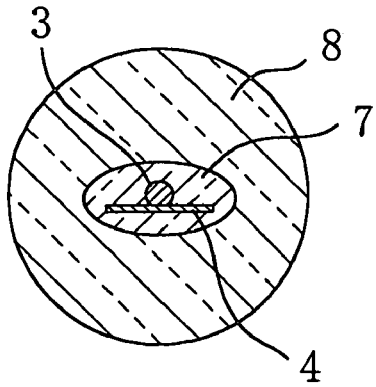

It required very tough work to develop a practically usable high-pressure mercury lamp even with an operation pressure of about 30 MPa or higher. However, for example, by applying a structure illustrated in FIG. 1, the inventors successfully attained an ultra-high pressure lamp. FIG. 1B is a cross-sectional view taken along the line b—b of FIG. 1A.

A high-pressure discharge lamp (for example, a high- or ultrahigh-pressure mercury lamp) 100 illustrated in FIG. 1 is disclosed in U.S Patent Specification No. 2003-0168980-A1. The lamp 100 includes a luminous bulb 1 and a pair of sealing portions 2 for maintaining the airtightness of the luminous bulb 1. At least one of the sealing portions 2 includes a first glass portion 8 that extends from the luminous bulb 1, and a second glass portion 7 provided at least in an inner portion of the first glass portion 8. The one sealing portion 2 has a portion (20) to which compressive stress is applied.

The compressive stress applied to the portion of the sealing portion 2 functions effectively, if the stress is substantially beyond zero (i.e., 0 kgf/cm$^2$). The presence of the compressive stress allows the lamp 100 to have higher strength against pressure than lamps with the conventional structure. It is preferable that the compressive stress be not less than about 10 kgf/cm$^2$ (about $9.8\times10^5$ N/m$^2$) and not greater than about 50 kgf/cm$^2$ (about $4.9\times10^6$ N/m$^2$). When the compressive stress is less than 10 kgf/cm$^2$, the resultant compressive strain is so weak that the strength of the lamp against pressure may not be increased sufficiently. On the other hand, a structure having a compressive stress exceeding 50 kgf/cm$^2$ cannot be obtained, because there is no practical glass material available to do so. It should be, however, noted that even a compressive stress of less than 10 kgf/cm$^2$ can also increase the strength against pressure as compared to the conventional structure, as long as the compressive stress substantially exceeds zero. Furthermore, if a practical material that can realize a structure having a compressive stress of more than 50 kgf/cm$^2$ is developed, the second glass portion 7 may have a compressive stress of more than 50 kgf/cm$^2$.

The first glass portion 8 in the sealing portion 2, which contains 99 wt % or more of $SiO_2$, is made of quartz glass, for example. On the other hand, the second glass portion 7, which contains $SiO_2$ and at least one of 15 wt % or less of $Al_2O_3$ and 4 wt % or less of B, is made of Vycor glass, for example. When $Al_2O_3$ or B is added to $SiO_2$, the softening point of the resultant glass is decreased. This means that the softening point of the second glass portion 7 is lower than that of the first glass portion 8. To obtain such a reduction in the softening point of the second glass portion 7, the total amount of $Al_2O_3$ and B contained in the second glass portion 7 is preferably more than 1 wt %. Vycor glass (product name) is obtained by mixing additives into quartz glass, and thus has a decreased softening point and hence improved processability than the quartz glass. For example, Vycor glass can be produced by subjecting borosilicate glass to a thermal and chemical treatment to make the characteristics of the borosilicate glass similar to those of quartz. An exemplary composition of Vycor glass is as follows: 96.5 wt % of silica ($SiO_2$); 0.5 wt % of alumina ($Al_2O_3$); and 3 wt % of boron (B). In this embodiment, the second glass portion 7 is formed of a glass tube made of Vycor glass. In stead of the glass tube made of Vycor glass, a glass tube containing 62 wt % of $SiO_2$, 13.8 wt % of $Al_2O_3$, and 23.7 wt % of CuO may be used.

Electrode rods 3, each having an end portion positioned in a discharge space, are connected, by welding, to respective metal foils 4 provided in the sealing portions 2. At least part of each metal foil 4 is positioned in the corresponding second glass portion 7. In the structure shown in FIG. 1, the respective second glass portion 7 covers a portion that includes the connection portion of the electrode rod 3 and the metal foil 4. As shown in FIG. 1B, in a transverse cross section of the sealing portion 2 (a cross section of the sealing portion 2 intersecting perpendicularly to the longitudinal direction thereof), the entire periphery of the metal foil 4 is covered with the second glass portion 7. In this manner, the entire widthwise periphery of at least a portion of each metal foil 4 is covered with the corresponding second glass portion 7. In that covered portion, the edge portion of the metal foil 4 is covered with the second glass portion 7. Exemplary dimensions of the second glass portion 7 in the structure shown in FIG. 1 are as follows. The length of the sealing portion 2 in the longitudinal direction is from about 2 to 20 mm (e.g., 3 mm, 5 mm or 7 mm), and the thickness of the second glass portion 7 interposed between the first glass portion 8 and the metal foil 4 is from about 0.01 to 2 mm (e.g., 0.1 mm). The distance H extending from the end face of the second glass portion 7 located closer to the luminous bulb 1 to the discharge space 10 in the luminous bulb 1 is from about 0 mm to about 6 mm (e.g., from 0 mm to about 3 mm, or from 1 mm to 6 mm). When the second glass portion 7 is not desired to be exposed into the discharge space 10, the distance H is larger than 0 mm, and for example, 1 mm or more. The distance B extending from the end face of the metal foil 4 located closer to the luminous bulb 1 to the discharge space 10 in the luminous bulb 1 (in other words, the length of the portion of the electrode rod 3 that is buried alone in the sealing portion 2) is, for example, about 3 mm.

Figure 2A:
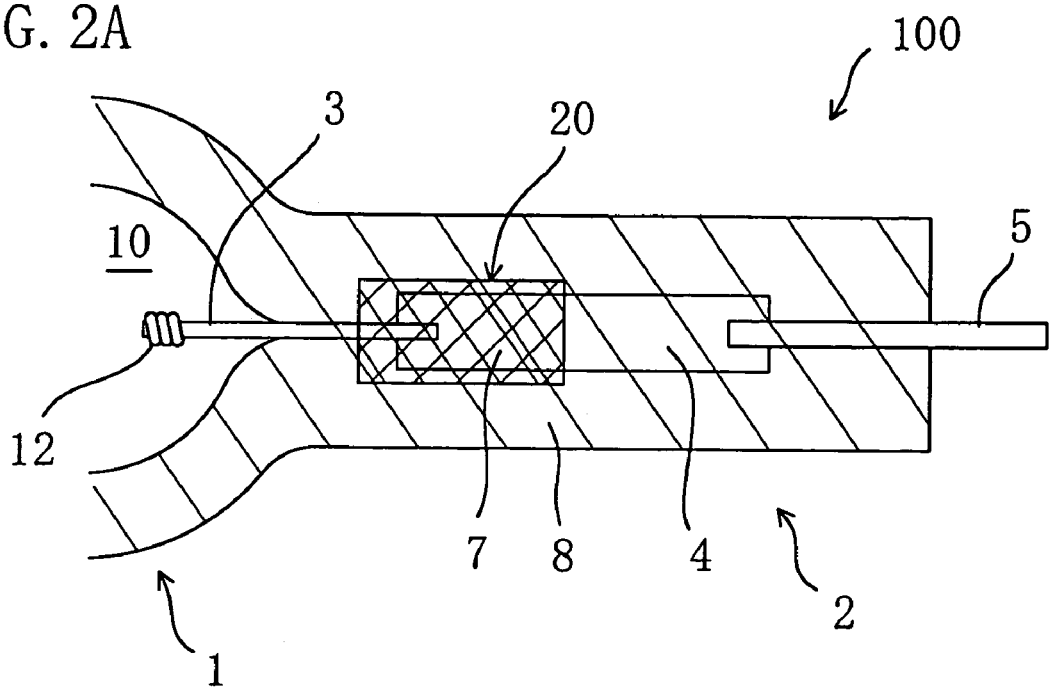
FIGS. 2A and 2B are enlarged views of the principal part showing the distribution of compressive strain along the longitudinal direction (electrode axis direction) of a sealing portion 2.
Figure 2B:
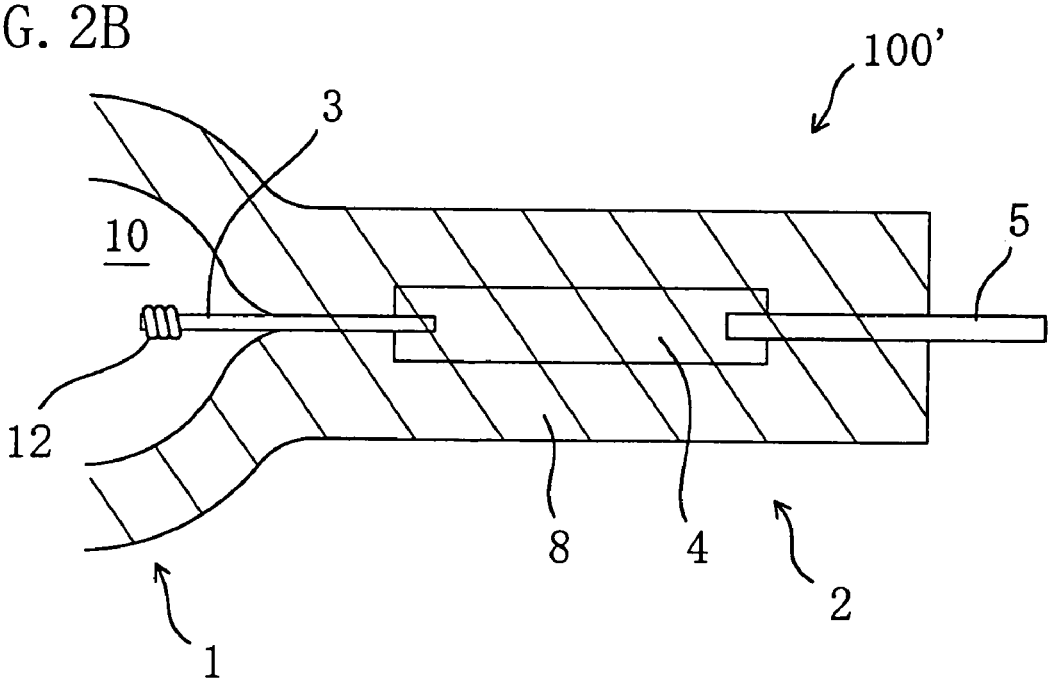

Next, compressive strain produced in the sealing portions 2 will be described. FIGS. 2A and 2B are schematic views each showing distribution of compressive strain created in the longitudinal direction (direction of the electrode axis) of a sealing portion 2. FIG. 2A indicates compressive-strain distribution in a lamp 100 that includes a second glass portion 7, while the FIG. 2B indicates compressive-strain distribution in a lamp 100' in which no second glass portion 7 is provided (comparative example).

In the sealing portion 2 shown in FIG. 2A, compressive stress (compressive strain) is present in a region (cross-hatched region) corresponding to the second glass portion 7, while the magnitude of compressive stress in the first glass portion 8 (hatched region) is substantially zero. On the other hand, as shown in FIG. 2B, in the case of the sealing portion 2 including no second glass portion 7, there is no portion in which compressive strain is locally present, and the magnitude of compressive stress of the first glass portion 8 is substantially zero.

The present inventors actually measured strain within the lamp 100 quantitatively, and observed that a compressive stress is present in the second glass portion 7 in the sealing portion 2. The strain was quantified by a sensitive color plate method utilizing photoelastic effect. The measuring device used in quantifying the strain is a strain detector (SVP-200 manufactured by Toshiba Corporation), and when this strain detector is used, the magnitude of the compressive strain in the sealing portion 2 can be obtained as the average of the stress applied to the sealing portion 2.

The principle of the strain measurement by the sensitive color plate method utilizing photoelastic effect will be described briefly with reference to FIG. 15. FIGS. 15A and 15B are each schematic views showing the state in which linearly polarized light obtained by transmitting light through a polarizing plate is incident to glass. Herein, when the vibration direction of the linearly polarized light is a direction u, the direction u can be regarded as being obtained by synthesizing directions u1 and u2.

Figure 15A:
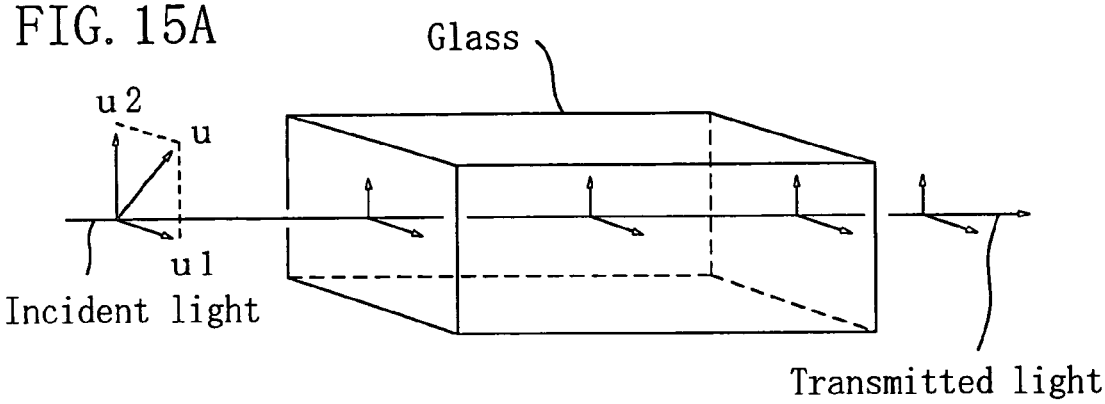
FIGS. 15A and 15B are drawings for explaining the principle of the measurement of strain by a sensitive color plate method utilizing photoelastic effect.
Figure 15B:
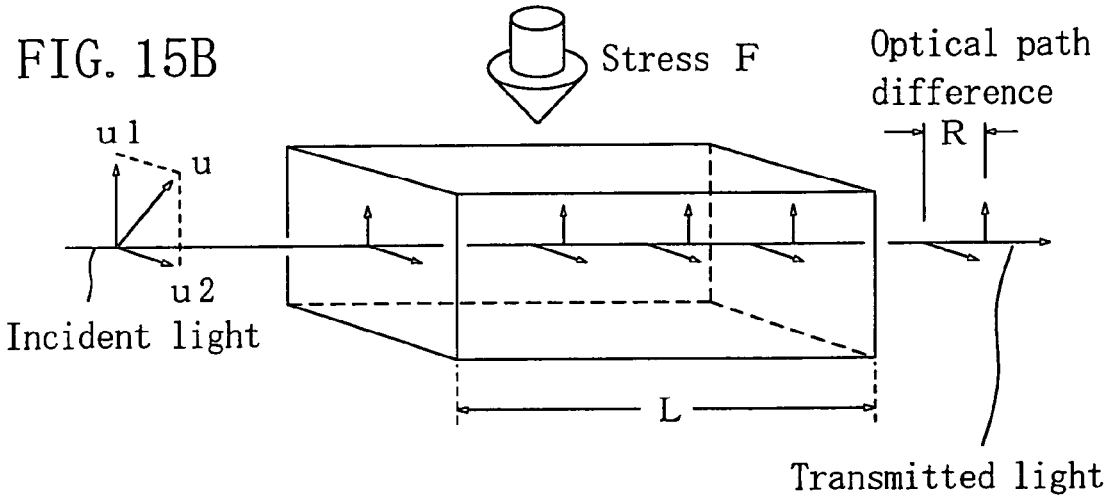

As shown in FIG. 15A, when there is no strain in the glass, respective light components in the directions u1 and u2 are transmitted through the glass at the same speed, such that no discrepancy occurs between the transmitted light components in the directions u1 and u2. On the other hand, as shown in FIG. 15B, if there is a strain in the glass and a stress F is applied thereto, the light components in the directions u1 and u2 are not transmitted through the glass at the same speed, such that a discrepancy is produced between the transmitted light components in the directions u1 and u2. Specifically, one of the light components in the directions u1 and u2 lags behind the other. The lag caused by this delay is referred to as the optical path difference. Since the optical path difference R is proportional to the stress F and the glass transmission distance L, the optical path difference R can be expressed as $$R=C\cdot F\cdot L$$

where C is a proportional constant. The respective units of the marks are as follows: R (nm); F (kgf/cm$^2$); L (cm); and C ({nm/cm}/{kgf/cm$^2$}). The character "C" denotes a constant that is referred to as a "photoelastic constant", and varies depending on the quality of the glass and other material. As seen from the above equation, if C is known, L and R can be measured to obtain F.

The inventors measured the light transmission distance L in the sealing portion 2, that is, the outer diameter L of the sealing portion 2, and then obtained the optical path difference R by observing the color of the sealing portion 2 at the time of the measurement by using a strain standard. As the photoelastic constant C, the photoelastic constant of quartz glass, which is 3.5, was used. These values were substituted in the above equation to calculate the stress value, and the compressive strain in the longitudinal direction of the metal foil 4 is quantified with the calculated stress value.

In this measurement, the stress in the longitudinal direction (direction in which the electrode rod 3 extends) of the sealing portion 2 was observed, which however does not mean that there is no compressive stress in the other directions. In order to determine whether or not compressive stress is present in the radial direction (the direction from the central axis toward the outer circumference, or the opposite direction), or in the circumferential direction (e.g., the clockwise direction) of the sealing portion 2, the luminous bulb 1 or the sealing portion 2 have to be cut. However, once such cutting is performed, the compressive stress in the second glass portion 7 is released quickly. Therefore, only the compressive stress in the longitudinal direction can be measured without cutting the lamp 100. Consequently, the inventors quantified the compressive stress at least in this direction.

In the lamp 100 of this embodiment, compressive strain (at least compressive strain in the longitudinal direction) is present in the second glass portion 7 provided at least in an inner portion of the first glass portion 8, so that the strength of the high-pressure discharge lamp against pressure can be improved. In other words, the lamp 100 of this embodiment shown in FIGS. 1 and 2A can have a higher strength against pressure than the comparative lamp 100' shown in FIG. 2B. The lamp 100 of this embodiment shown in FIG. 1 is capable of operating at an operating pressure of 30 MPa or more, which exceeds the highest level, about 20 MPa, of the conventional lamps.

Figure 16A:
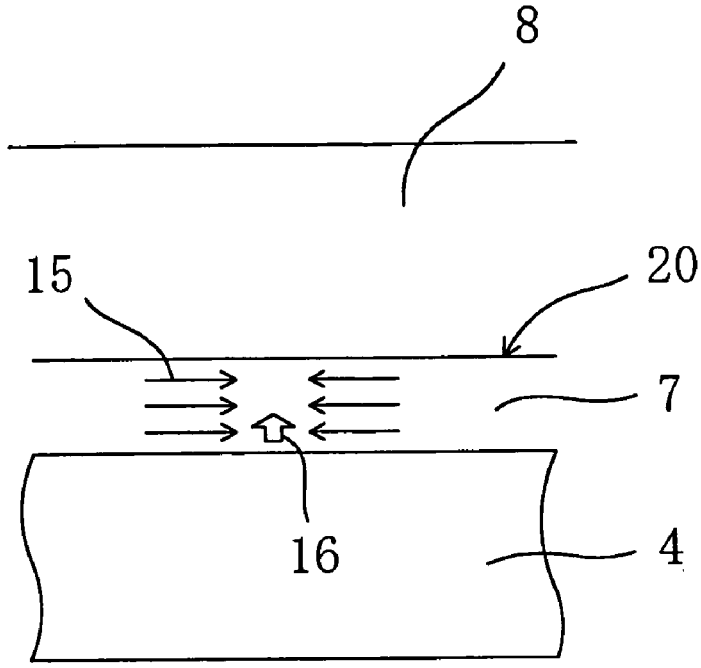
FIGS. 16A and 16B are enlarged views of the principal part of the lamp 100 for explaining the reason why the strength of the lamp 100 against pressure is increased by compressive strain occurring in a second glass portion.
Figure 16B:
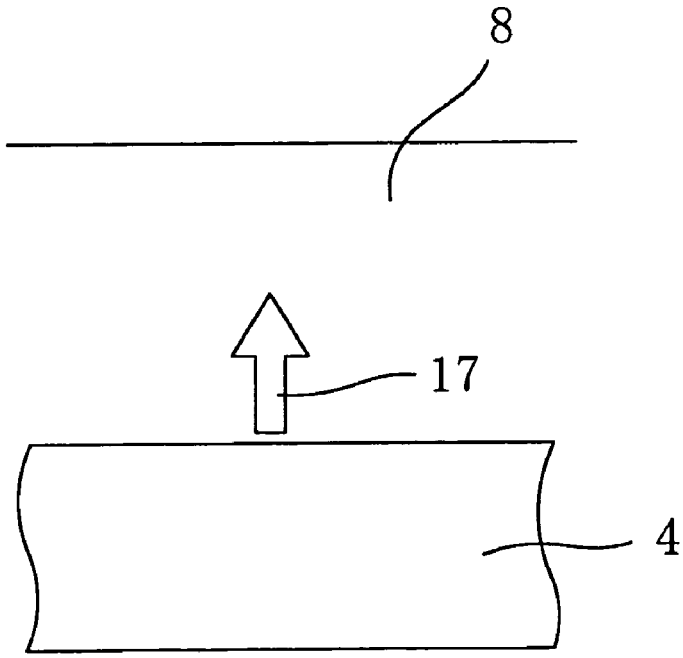

Next, the reasons why the strength of the lamp 100 against pressure is increased by the compressive strain produced in the second glass portion 7 will be described with reference to FIG. 16. FIG. 16A is an enlarged view of the principal part of the sealing portion 2 in the lamp 100, while FIG. 16B is an enlarged view of the principal part of the sealing portion 2 in the comparative lamp 100'.

Although the mechanism behind the increase in the strength of the lamp 100 against pressure has not yet been elucidated sufficiently, the present inventors' thinking concerning the mechanism is as follows.

First, the premise is that the metal foil 4 in the sealing portion 2 is heated and expanded while the lamp operates, so that stress from the metal foil 4 is applied to the glass portion of the sealing portion 2. More specifically, in addition to the fact that the thermal expansion coefficient of metal is larger than that of glass, the metal foil 4 which is thermally connected to the electrode rod 3 and through which current is transmitted is heated more readily than the glass portion of the sealing portion 2. Therefore, stress is applied more readily from the metal foil 4 (in particular, from the lateral sides of the foil whose areas are small) to the glass portion.

As shown in FIG. 16A, it is considered that when compressive stress is applied in the longitudinal direction of the second glass portion 7, occurrence of stress 16 from the metal foil 4 can be suppressed. In other words, the compressive stress 15 of the second glass portion 7 can presumably suppress the occurrence of the large stress 16. As a result, for example, the possibility of generating cracks in the glass portion of the sealing portion 2 or causing leakage between the glass portion of the sealing portion 2 and the metal foil 4 is reduced, so that the strength of the sealing portion 2 can be improved.

On the other hand, as shown in FIG. 16B, in the case of the structure not provided with the second glass portion 7, stress 17 from the metal foil 4 is presumably larger than that of the structure shown in FIG. 16A. Specifically, it is considered that since there is no region, to which compressive stress is applied, in the surroundings of the metal foil 4, the stress 17 from the metal foil 4 becomes larger than the stress 16 shown in FIG. 16A. Consequently, it is inferred that in the structure shown in FIG. 16A, the strength against pressure can be increased more as compared to the structure shown in FIG. 16B. This inference is compatible with a basic property of glass: tensile strain (tensile stress) introduced into glass makes it break easily, while compressive strain (compressive stress) introduced into glass makes it resistant to breaking.

However, from the basic property of glass that the presence of compressive stress in glass makes it less breakable, it cannot be inferred that the sealing portion 2 of the lamp 100 has high strength against pressure. This is because of the following possible inference. Even if the glass strength is increased in the region having compressive strain, a load is assumed to be generated in the sealing portion 2 as a whole, as compared to the case where there is no strain. The load would in turn reduce the strength of the entire sealing portion 2. However, it was not found until the inventors sampled and studied the lamp 100 that the strength of the lamp 100 against pressure was improved, which could not be derived from the theory alone. If compressive stress larger than necessary remains in the second glass portion 7 (or in the vicinity of the outer circumference thereof), the sealing portion 2 may actually be damaged during lamp operation and the life of the lamp may be shortened on the contrary. In view of these, it is considered that the structure of the lamp 100 having the second glass portion 7 exhibits high strength against pressure under a superb balance between various conditions. Inferring from the fact that the strain of the second glass portion 7 is released when the luminous bulb 1 is cut, the load resulting from the strain of the second glass portion 7 may be well received by the entire luminous bulb 1.

It is also presumed that the structure exhibiting higher strength against pressure is brought about by the portion 20 that is subjected to compressive stress generated by the difference in the compressive stress between the first glass portion 8 and the second glass portion 7. More specifically, the following inference is possible. There is substantially no compressive stress in the first glass portion 8, and compressive strain is well confined into a region of only the second glass portion 7 (or the vicinity of the outer circumference) positioned closer to the center than the portion 20 to which the compressive stress is applied. This would succeed in providing excellent withstand-pressure characteristics. As a result of the fact that stress values are indicated discretely because of the principle of the strain measurement by the sensitive color plate method, the portion 20 to which the compressive stress is applied is distinctly illustrated in FIG. 16 or other drawings. However, even if the actual value of the stress should be able to be indicated continuously, the stress value is believed to change drastically in the portion 20, and the portion 20 to which the compressive stress is applied can be defined by the region where the stress value changes drastically.

Figure 3A:
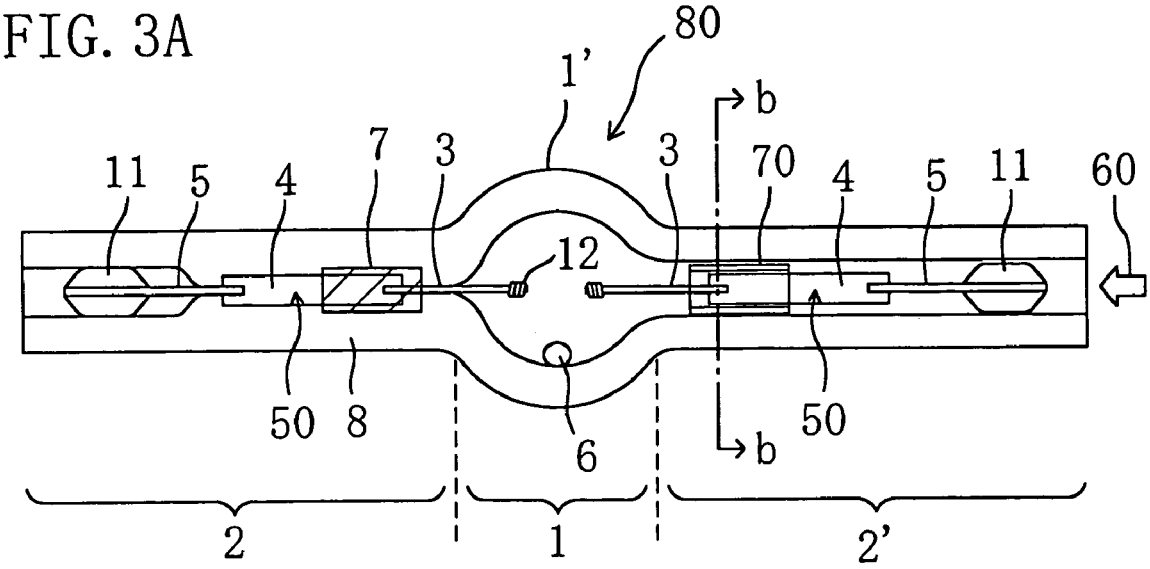
FIG. 3A is a cross-sectional view for explaining a process step of a method for manufacturing the lamp 100.
Figure 3B:
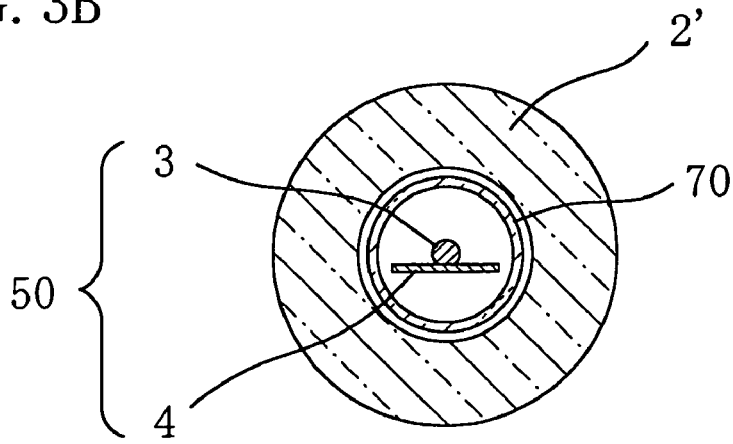
FIG. 3B is a cross sectional view taken along the line b—b of FIG. 3A.

As shown in FIG. 3A, in manufacturing the lamp 100, a glass tube 70 and an electrode structure 80 are inserted into a side tube portion 2'. The side tube portion 2' is then heated to shrink, thereby forming a sealing portion. On the left-hand side of FIG. 3A, there is shown the configuration of the sealing portion 2 formed by the heat and shrinkage process of the side tube portion 2'. Illustrated on the right-hand side, on the other hand, is the structure in which the glass tube 70 and the electrode structure 80 are inserted into the side tube portion 2'. FIG. 3B, provided for reference purposes, is a cross section taken along the line b—b of FIG. 3A.

If the glass tube 70 is made of Vycor glass, which is porous glass, the glass tube 70 adsorbs many impurities (mostly water). Those impurities remain as bubbles in the glass of the sealing portion, after the sealing portion has been formed. This results in a decrease in the glass strength (strength against pressure), which is unfavorable in order to obtain a high-pressure discharge lamp capable of withstanding high pressure (or ultra-high pressure).

Even if glass tubes made of Vycor glass are dried, the storage of those glass tubes has to be controlled strictly, because Vycor glass is hygroscopic. In order to avoid the glass tubes from taking up moisture, the glass tubes may be wrapped one by one, for example. However, this is unpractical because such wrapping requires much labor and costs.

Glass tubes made of Vycor glass produce another problem in that Vycor glass reacts with halogen, which will be described in detail below.

To increase the life of a high-pressure discharge lamp, halogen cycles must be utilized. To realize a long-life lamp, it is required to perform a process step in which a halogen precursor (e.g., $CH_2Br_2$) that is decomposed into halogen is introduced as indicated by an arrow 60, and such a step becomes important. Instead of $CH_2Br_2$, HBr may be introduced. The amount of halogen necessary for a satisfactorily sustainable halogen cycle is detailed in the international application No. PCT/JP00/04561 (the international filing date: Jul. 6, 2000, applicant: Matsushita Electric Industrial Co., Ltd.). The present invention utilizes the international application No. PCT/JP00/04561 for reference. It should be noted that bromine ($Br_2$) can also be used as a halogen species. However, since bromine is highly reactive, in consideration of handling, a halogen precursor (e.g., $CH_2Br_2$ or HBr), which is decomposed into halogen, is preferably used to introduce halogen.

If the glass tube 70 to serve as the second glass portion 7 is absent in the state shown in FIG. 3, no particular problem arises in the introduction of $CH_2Br_2$ or HBr. At first, the present inventors introduced a halogen precursor (for example, $CH_2Br_2$) as a halogen species into the lamp including the glass tube 70, as in the case of a lamp with no glass tube 70 inserted. Then, the inventors found that the following problems arise.

The glass tube 70 is made of glass (e.g., Vycor glass) having a lower melting point than the quartz glass constituting the side tube portion 2'. As mentioned above, this glass is formed by mixing quartz glass with additives. A halogen precursor (e.g., $CH_2Br_2$ or HBr) does not react substantially with the quartz glass (the side tube portion 2'), but it exerts an influence on the glass (Vycor glass) constituting the glass tube 70, causing alteration in the composition of that glass. In particular, in the state as shown in FIG. 3A, in which a halogen precursor has been completely introduced, when the circumferential periphery of the side tube portion 2' is heated with a burner or the like to form the sealing portion, a gas of the halogen precursor adhering onto the glass tube 70 or existing within the luminous bulb portion 1' acts as a corrosive gas to the glass tube 70. The glass tube 70, exposed to the high-temperature corrosive gas, loses its Na component, for example, so that the composition of the glass tube 70 is altered. This alternation causes corresponding changes in the thermal characteristic of the glass forming the glass tube 70, such as an increase in the strain point thereof. If the strain point of the glass constituting the glass tube 70 is increased and approaches too near the strain point of quartz glass, it becomes difficult to cause strain (compressive strain) to occur in the second glass portion 7, or no strain might be produced therein in some cases. In other cases, cracks might be created between the first glass portion 8 and the second glass portion 7. Furthermore, such composition alteration might lead to a decrease in the tight contact between the metal foil and the Vycor glass, thereby causing a decrease in the strength against pressure.

Furthermore, under the influence of halogen or a halogen precursor, if the impurities contained in the glass that constitutes the glass tube 70 exude out and invade the luminous bulb 1, the halogen cycle might be interfered by those impurities. Unless the halogen cycle functions well, realizing a long-life lamp is difficult.

Figure 4:
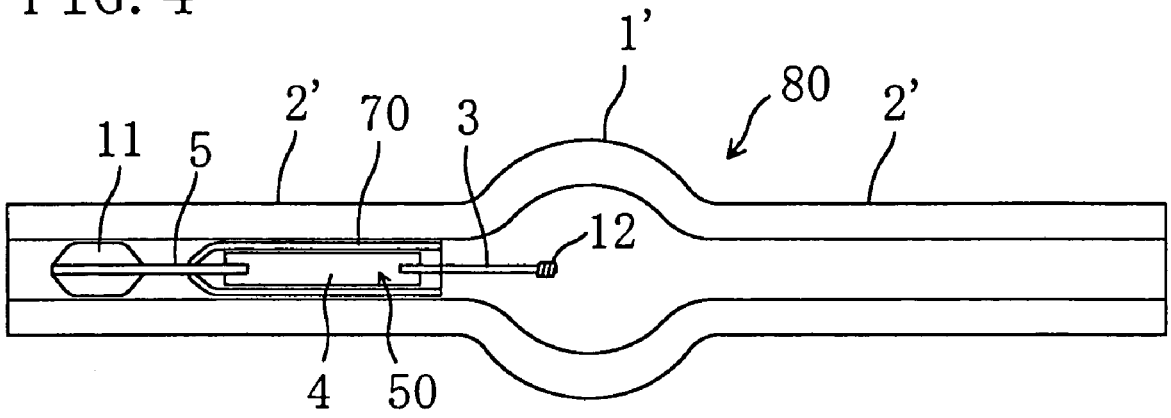
FIG. 4 is a cross-sectional view for explaining a process step of the method for manufacturing the lamp 100.

This kind of problem may also arise or even become more manifest in a lamp in which a long glass tube 70 that covers the entire metal foil 4 is used as shown in FIG. 4, because such a long glass tube 70 contains more impurities.

Figure 5A:
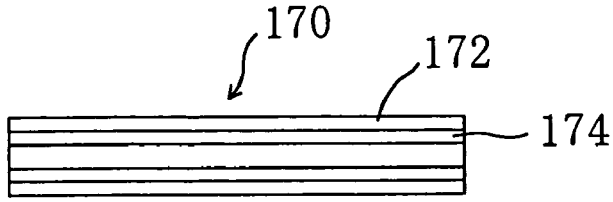
Figure 5B:
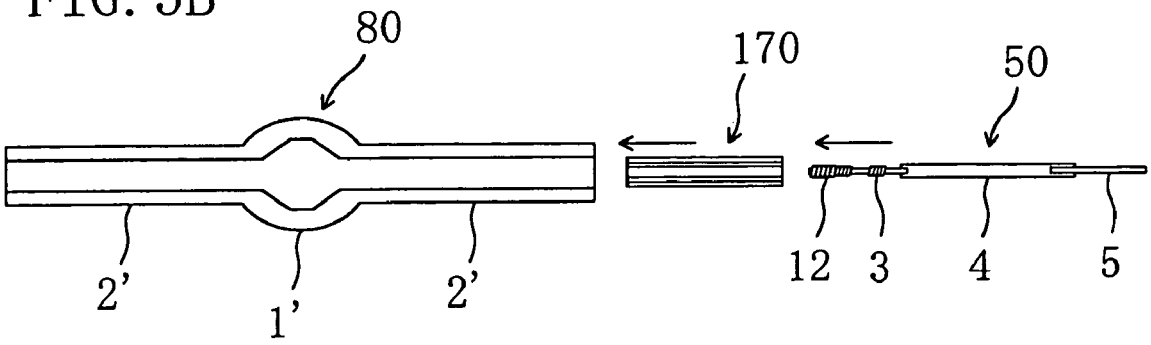
FIG. 5B is a cross-sectional view for explaining a process step of the method for manufacturing the lamp 100.
Figure 6:
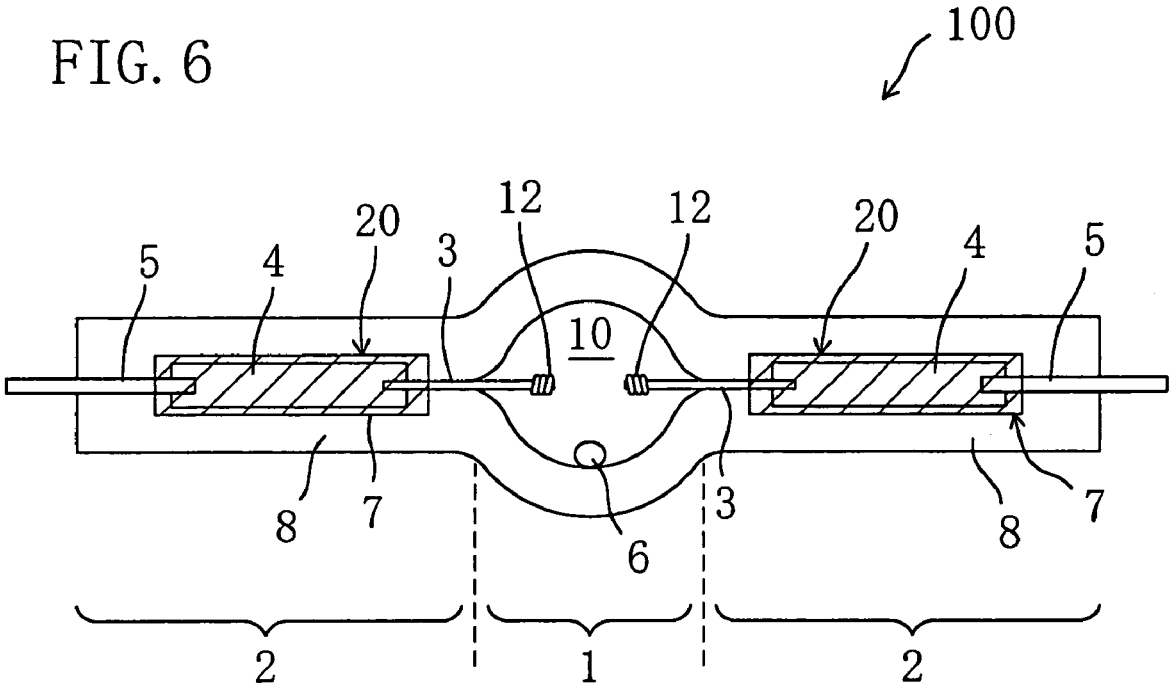
FIG. 6 is a schematic cross-sectional view illustrating another structure of the lamp 100.

In order to solve the above problem, the present inventors made investigation intensively, and finally achieved the present invention. In the present invention, a compound glass tube 170, which includes a surface layer (outer surface) 172 made of quartz glass and an inner-face layer 174 made of Vycor glass, is used as shown in FIG. 5A, and an electrode structure 50 is inserted into the compound glass tube 70 as shown in FIG. 5B. By this structure, the present invention has succeed in maintaining contact between the Vycor glass 174 and a metal foil 4, while suppressing impurities in the Vycor glass 174 from exuding out.

Hereinafter, embodiments of the present invention will be described with reference to the accompanying drawings. In the following drawings, for simplification of description, elements having substantially the same function bear the same reference numerals. The present invention is not limited to the following embodiments.

(First Embodiment)

A high-pressure discharge lamp according to a first embodiment of the present invention will be discussed in the following paragraphs. The high-pressure discharge lamp of this embodiment uses a compound glass tube (designated by the reference numeral 170 in FIG. 5A) to form a sealing portion 2, unlike the above-mentioned structure in which the glass tube 70 made of Vycor glass is employed to form the sealing portion 2. A compound glass tube used in a manufacturing method in accordance with this embodiment includes an outer tube made of a first glass and an inner tube made of a second glass. The second glass has a lower softening point than the first glass that also forms a side-tube portion. The outer tube is in tight contact with the periphery of the inner tube.

Although in the high-pressure discharge lamp of this embodiment, the compound glass tube 170 is used to form the sealing portion 2, the first glasses (e.g., quartz glasses) forming the side-tube portion 2' and the outer tube of the compound glass tube are heated and melt to become one body. Therefore, the resultant high-pressure discharge lamp of this embodiment has substantially the same structure as that of FIG. 1, except that the first glass portion of the inventive lamp is thicker than the sealing portion 2 shown in FIG. 1. Hence, for the sake of simplicity, the high-pressure discharge lamp of this embodiment will be also denoted by the reference numeral 100, and described with reference to FIG. 1. Description of the same elements as those of the structure shown in FIG; 1 will be omitted or simplified.

The lamp 100 of this embodiment is a double-end lamp having two sealing portions 2. As shown in FIG. 1, it is preferable that second glass portions 7 be disposed in such a manner as to cover at least welded-connection portions of electrode rods 3 and metal foils 4, which reduces the probability of breakage of the lamp even when the lamp operates under the condition of an ultrahigh withstand-pressure, e.g., 35 MPa. As another exemplary configuration applicable in covering the welded joints between the electrode rods 3 and the metal foils 4, each second glass portion 7 may be disposed to cover the entire metal foil 4 buried in the sealing portion 2 and part of each electrode rod 3 as shown in FIG. 5. The exemplary length of the second glass portions 7 of FIG. 5 is from about 10 to 30 mm (about 20 nm, for example) in the longitudinal direction of the sealing portions 2.

In the lamp 100 of this embodiment, the compound glass tubes (170) are used to form the sealing portions 2. In each sealing portion 2, the outwardly located outer tube 172 (the layer formed of the first glass, for example, a quartz glass layer) suppresses impurities contained in the inner tube 174 (the layer formed of the second glass, for example, a Vycor glass layer) from exuding out, thereby making it possible to prevent the generation of bubbles in the sealing portion 2. The inner surfaces of the inner tubes 172, which are in contact with external air, might have moisture due to the hygroscopic property of the second glass (Vycor glass, for example). This moisture, however, presents no problem, because even if a thin oxidized region is created on the surfaces of the metal foils (molybdenum foils) 4 in contact with the respective (inner) surfaces of the inner tubes 174, the resultant metal oxide (molybdenum oxide, for example) makes stronger contact with the glass (the oxide, e.g., $SiO_2$) because in terms of cohesion the affinity will be better between metal oxides and glass. For this reason, any moisture on the (inner) surface of the inner tubes 174 causes no problem. Furthermore, the inner tubes 174 are in tight contact with the respective outer tubes 172 with no clearance existing therebetween, resulting in better contact between the first and second glass portions 8 and 7. The configuration in accordance with this embodiment therefore allows achieving a high-pressure discharge lamp that exhibits higher withstand pressure and increased reliability.

The lamp 100 of this embodiment is capable of withstanding pressures (operating pressures) of 20 MPa or more (e.g., about 30 to 50 MPa or more). Moreover, the bulb wall load in the lamp 100, which is higher than about 60 W/cm$^2$, e.g., has any particularly established upper limit. But the bulb wall load of an achievable lamp is in the range from about 60 W/cm$^2$ to about 300 W/cm$^2$ (preferably about 80 to 200 W/cm$^2$) for example. If cooling means is provided, a bulb wall load of 300 W/cm$^2$ or higher can be achieved. The rated power is, for example, 150 W (the bulb wall load in this case is about 130 W/cm$^2$).

The configuration according to this embodiment will be described in further detail below.

The luminous bulb 1 in the lamp 100 is substantially spherical, and is made of quartz glass as in the case of the first glass portions 8. As shown in FIGS. 1 and 5, the luminous bulb 1 is designed in a tipless shape, which requires luminous material 6 to be introduced from a side tube portion, instead of from an opening otherwise provided in the luminous bulb 1.

In order to realize a high-pressure mercury lamp (in particular, ultrahigh-pressure mercury lamp) exhibiting a long life and other excellent properties, the luminous bulb 1 is preferably made of high-purity quartz glass that contains alkali metal impurities at low levels (e.g., Na, K, and Li each at 1 ppm or less). It is of course possible to use quartz glass in which alkali metal impurities are contained at normal levels. The outer diameter of the luminous bulb 1 is, for example, from about 5 mm to 20 mm, while the glass thickness thereof is, for example, from about 1 mm to 5 mm. The volume of a discharge space (10) in the luminous bulb 1 is, for example, from about 0.01 to 1 cc (0.01 to 1 cm$^3$). The luminous bulb 1 employed in this embodiment has an outer diameter of about 9 mm, an inner diameter of about 4 mm, and a discharge-space volume of about 0.06 cc.

In the luminous bulb 1, a pair of electrode rods (electrodes) 3 are opposed to each other. The electrode rods 3, each made of tungsten (W), are disposed with their heads opposed in the luminous bulb 1 at a distance (arc length) of about from 0.2 to 5 mm (e.g., from 0.6 mm to 1.0 mm). What is preferably used as the tungsten electrode rods 3 contains low levels of alkali metal impurities (e.g., Na, K, and Li each at 1 ppm or less), but it is also possible to employ electrode rods 3 in which alkali metal impurities are included at normal levels. A coil 12 is wound around the respective heads of the electrode rods 3 in order to reduce the temperature of the electrode heads during lamp operation. In this embodiment, the coils 12 are made of tungsten, but coils made of thorium-tungsten may be used. Similarly, for the electrode rods 3, not only tungsten rods but also rods made of thorium-tungsten may be used.

In the luminous bulb 1, mercury 6 as luminous material is enclosed. To operate the lamp 100 as an ultrahigh-pressure mercury lamp, enclosed in the luminous bulb 1 are about at least 200 mg/cc or more (220 mg/cc or more, 230 mg/cc or more, or 250 mg/cc or more), preferably 300 mg/cc or more (e.g., 300 mg/cc to 500 mg/cc) of mercury 6, and a rare gas (e.g., argon) at 5 to 30 kPa.

Enclosed in the luminous bulb 1 is a halogen precursor that decomposes to generate halogen. The halogen precursor may be $CH_2Br_2$, HBr, and $HgBr_2$, for example. In this embodiment, mercuric bromide ($HgBr_2$) is enclosed as the halogen precursor. Halogen (that is, Br) created by the decomposition of the halogen precursor serves for the halogen cycle in which W (tungsten) that evaporates from the electrodes rods 3 during lamp operation is returned to the electrode rods 3. The amount of enclosed $HgBr_2$ is from about 0.002 to 0.2 mg/cc. When this amount of $HgBr_2$ is enclosed, halogen atoms are created at a density of from about 0.01 to 1 μmol/cc during lamp operation.

One of the advantages of using $HgBr_2$ is that Br and Hg are produced by the decomposition of $HgBr_2$. In other words, the resulting product other than the halogen is mercury, which is the element already enclosed therein. In this respect, $HgBr_2$ is different from $CH_2Br_2$ or HBr that will create hydrogen (H). Such hydrogen possibly combines with the halogen again, so that the amount of free halogen may not be fixed because it depends upon the amount of free hydrogen. As disclosed in the afore-mentioned international application No. PCT/JP00/04561, if halogen that contributes to the halogen cycle is always secured in the luminous bulb 1 so that the halogen cycle works reliably, blackening which occurs in the luminous bulb 1 can be positively prevented. However, in the case where hydrogen (free hydrogen) is generated by the decomposition, halogen combined with such free hydrogen does not always contribute to the halogen cycle. Consequently, the amount of free halogen that surely contributes to the halogen cycle is not fixed, such that there is a possibility that blackening cannot be prevented positively. In consideration of this, it is found that $HgBr_2$, which eliminates the above-mentioned possibility, has great advantages over the other elements because the amount of halogen to be introduced can be easily calculated.

In this embodiment, it is preferable that the number of moles of halogen created by the halogen precursor enclosed in the luminous bulb 1 be greater than the sum of the number of moles of all metal elements (other than tungsten and mercury) that exist in the luminous bulb 1 and that have the properties of combining with halogen, and the number of moles of tungsten that evaporates from the electrodes 3 during lamp operation and exists in the luminous bulb 1. This ensures the continuous presence of halogen contributing to the halogen cycle in the luminous bulb 1, allowing the halogen cycle to work reliably. Typical examples of metal elements that have the properties of combining with halogen include alkali metal elements (such as Na, K and Li) in addition to tungsten and mercury.

As described above, the metal foils 4 are disposed in the respective central portions of the sealing portions 2 in cross section, which is substantially circular. The metal foils 4 are, for example, rectangular molybdenum foils (Mo foils), and the width (the length of the shorter sides) of each metal foil 4 is, for example, from about 1.0 mm to about 2.5 mm (preferably, about 1.0 mm to about 1.5 mm). The thickness of each metal foil 4 is, for example, from about 15 μm to about 30 μm (preferably about 15 μm to about 20 μm). The ratio of the thickness to the width is about 1:100. The length (the length of the longer sides) of each metal foil 4 is, for example, from about 5 mm to about 50 mm.

External leads 5 are disposed by welding opposite to where the respective electrode rods 3 are located. Specifically, each external lead 5 is connected to the side of the corresponding metal foil 4 opposite to the side thereof to which the respective electrode rod 3 is connected, and one end of the external lead 5 extends to the outside of the sealing portion 2. The external leads 5 are electrically connected to a ballast circuit (not shown) to establish electrical connection between the ballast circuit and the pair of electrode rods 3. The sealing portions 2 attach by pressure the glass portions (7 and 8) to the metal foils 4, thereby maintaining the airtightness in the discharge space 10 in the luminous bulb 1. The sealing mechanism by the sealing portions 2 will be described briefly below.

The material constituting the glass portions in the sealing portions 2 and the molybdenum constituting the metal foils 4 have different thermal expansion coefficients. Therefore, in view of the thermal expansion coefficient, the glass portions and the metal foils 4 are not integrated into one unit. However, in the structure (foil sealing) of this embodiment, each metal foil 4 is plastically deformed by the pressure from the glass portion in the sealing portion, so that the gap created between the metal foil 4 and the glass portion can be filled. This permits the glass portion of the sealing portion 2 and the metal foil 4 to press against each other, thus allowing the sealing portions 2 to seal the luminous bulb 1. That is, the sealing portions 2 are sealed by means of foil sealing in which the respective glass portion of the sealing portions 2 is attached by pressure against the metal foil 4. In this embodiment, since the second glass portions 7 having compressive strain are provided, the reliability of the sealing structure is increased.

In the lamp 100 according to this embodiment, compressive strain is present in the second glass portions 7 (at least in the longitudinal direction thereof) provided at least in portions inside the first glass portions 8, thereby improving the strength of the high-pressure discharge lamp against pressure. Moreover, the compound glass tubes 170 are used to form the sealing portions 2, which suppresses bubbles from occurring in the glasses in the sealing portions. In addition, alteration in the second glasses 7 is suppressed, such that compressive strain is created more reliably in the sealing portions 2, thereby achieving a high-pressure discharge lamp capable of withstanding high pressures.

Although in the foregoing description, the first glass is quartz glass, while the second glass is Vycor glass, the second glass may be glass that contains 62 wt % of $SiO_2$, 13.8 wt % of $Al_2O_3$, and 23.7 wt % of CuO. The compound glass tubes 170 may have a three-layer structure that includes from the outside a quartz glass layer, a Vycor glass layer, and a glass layer containing 62 wt % of $SiO_2$, 13.8 wt % of $Al_2O_3$, and 23.7 wt % of CuO. In other words, it is possible to dispose those glass layers in order of increasing softening point from the inner layer to the outer layer. It should be noted that in the two-layer or three-layer (or greater multi-layer structure), the boundaries between the glasses might not be clear because the component concentrations therein are graded.

In the structure shown in FIG. 4, the second glass portions 7 are provided in the pair of sealing portions 2, but the present invention is not limited to this structure. Even when the second glass portion 7 is provided in only one of the sealing portions 2, the strength of the lamp 100 against pressure is higher than that of the comparative lamp 100' shown in FIG. 2B. However, it is preferable that the second glass portion 7 be provided in each of the sealing portions 2, and that both sealing portions 2 have a region to which compressive stress is applied. This is because a higher withstand pressure can be achieved when both the sealing portions 2 have a region to which compressive stress is applied, as compared to the case in which only one of them has such a region. That is, in the case where there are two sealing portions each having a portion where compressive stress is applied, the probability that leakage occurs in the sealing portions (i.e., the probability that a withstand pressure at a certain level cannot be maintained) can be half as compared to the case where one of the sealing portions has a portion where compressive stress is applied.

In this embodiment, a high-pressure mercury lamp in which a large amount of mercury 6 is enclosed (e.g., an ultrahigh-pressure mercury lamp in which mercury in an amount of more than 150 $mg/cm^3$ is enclosed) has been described. However, the present invention may be applied preferably to high-pressure mercury lamps whose mercury vapor pressure is not very high, e.g., about 1 MPa. This is because the fact that a lamp can be operated stably even at a very high operating pressure means that the reliability of the lamp is high. That is to say, if the structure of this embodiment is applied to a lamp having a not very high operating pressure (the operating pressure of the lamp is less than about 30 MPa, for example, from about 20 MPa to about 1 MPa), the reliability of the lamp which operates at that operating pressure can be improved. The structure of this embodiment can be obtained simply by providing the second glass portions 7 as new members in the sealing portions 2, which means that an increase in the withstand pressure can be achieved by this small structural improvement. Therefore, the present invention is very suitable for industrial applications. Moreover, in this embodiment, in consideration of the mechanism behind compositional deformation of the second glass portions 7, $HgBr_2$ acting as a halogen precursor is employed as means for preventing such compositional deformation.

Figure 7:
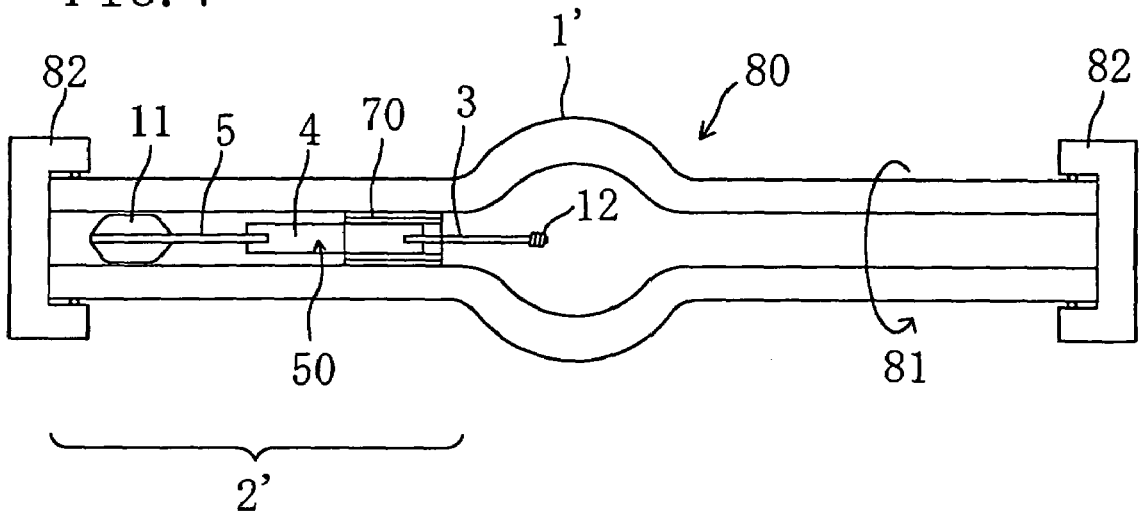
FIG. 7 is a cross-sectional view illustrating a process step in the method for manufacturing the lamp 100.

This small improvement ensures that the increase in the withstand pressure is maintained, which makes the present invention suitable for industrial applications. Next, a method for manufacturing the lamp 100 of this embodiment will be described with reference to FIGS. 7 through 9.

First, a glass pipe 80 designed for use in a discharge lamp, including a luminous bulb portion 1' that will be formed into the luminous bulb (1) of the lamp 100, and side tube portions 2' extending from the luminous bulb portion 1', is prepared. The glass pipe 80 of this embodiment is obtained by heating a predetermined position of a cylindrical quartz glass having an outer diameter of 6 mm and an inner diameter of 2 mm for expansion to form the substantially spherical luminous bulb portion 1'. Compound glass tubes 170 that will be formed into the second glass portions 7 are prepared separately. The compound glass tubes 170 of this embodiment are glass tubes having an outer diameter of 1.9 mm, an inner diameter of 1.6 mm, and a length (the longitudinal length) of 7 mm. The outer tube 172 of each compound glass tube 170 is a quartz glass tube (whose thickness is from 0.05 to 0.1 mm, for example), while the inner tube 174 thereof is a Vycor glass tube (whose thickness is from 0.05 to 0.1 mm, for example). The outer diameter of the compound glass tubes 170 is made smaller than the inner diameter of the side tube portions 2' of the glass pipe 80 so that the compound glass tubes 170 can be inserted into the side tube portions 2'.

Figure 8:
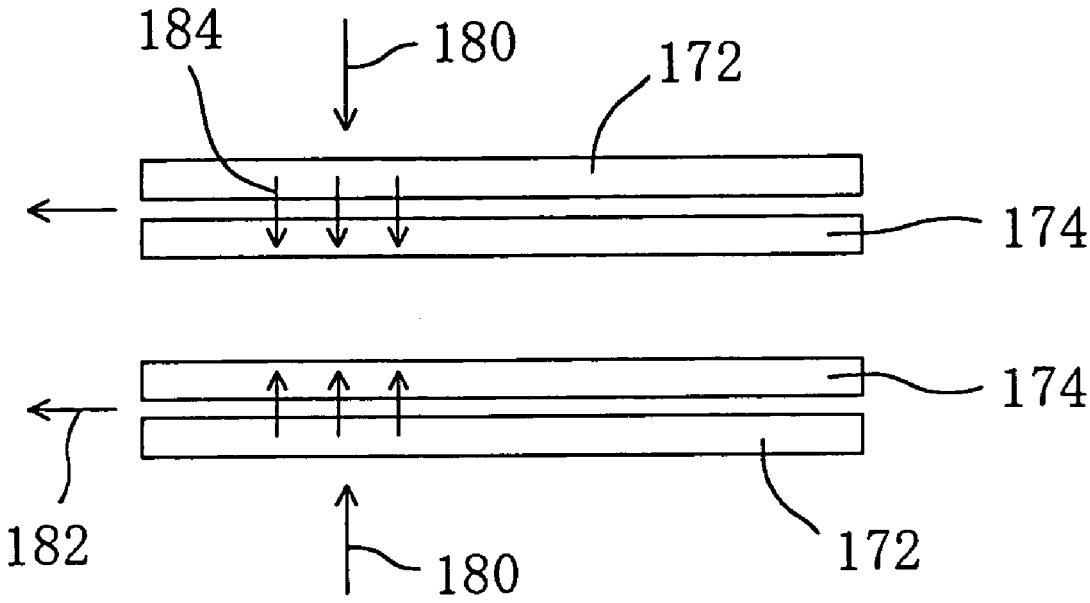
FIG. 8 is a cross-sectional view illustrating a method for manufacturing the compound glass tube 170.

In fabricating the compound glass tubes 170, the inner tube 174 of Vycor glass is inserted into the outer tube 172 of quartz glass as shown in FIG. 8. The pressure in the gap between the outer and inner tubes 172 and 174 is then reduced (as indicated by an arrow 182), while the outer tube 172 is heated. This allows the outer tube 172 shrink (as indicated by an arrow 184) to make tight contact with the inner tube 174. In this manner, the compound glass tube 170 is obtained. Once the compound glass tube 170 has put into form, no impurities (particularly, moisture) is adsorbed between the outer and inner tubes 172 and 174, even if the compound glass tube 170 is left in air all day long. The fact that the glass tube 170 may be left for a long period of time increases flexibility in performing the manufacturing process steps, which can result in a corresponding increase in the throughput. In a case of preparing compound glass tubes 170 to be inserted into the side tube portions 2', it is preferable that a relatively long compound glass tube (from 30 to 100 cm, for example) be manufactured and then cut into given lengths. In this way, it is possible to manufacture the compound glass tubes 170 in large quantities and more efficiently as compared to cases in which each compound glass tube 170 is manufactured individually.

It should be noted that the long glass tube 70 shown in FIG. 4 may be manufactured to be a compound glass tube 170 and employed in the lamp. That long glass tube has a reduced diameter at one end (that is, the end portion opposite to the luminous bulb portion 1'), by which the electrode structure is fixed. The electrode structure may be fixed by holding the external lead 5 by the reduced-diameter portion, or by setting the pipe 80 substantially perpendicular, and then securing edges of the metal foil (molybdenum foil) 4 by the small-diameter portion of the glass tube 70.

Next, the glass tube 170 is fixed in one of the side tube portions 2' of the glass pipe 80, after which a separately fabricated electrode structure 50 is inserted into the side tube portion 2' in which the glass tube 170 has been secured. Subsequently, the both ends of the glass pipe 80 with the electrode structure 50 inserted therein are attached to a rotatable chuck (not shown), while the airtightness in the glass pipe 80 is maintained. The chuck is connected to a vacuum system (not shown) and can reduce the pressure inside the glass pipe 80. After the glass pipe 80 is evacuated to a vacuum, a rare gas (Ar) at about 200 torr (about 20 kPa) is introduced. Thereafter, the glass pipe 80 is rotated around the electrode rod 3 serving as the central axis for the rotation in the direction indicated by an arrow 81.

The electrode structure 50 includes an electrode rod 3, a metal foil 4 connected to the electrode rod 3, and an external lead 5 connected to the metal foil 4. The electrode rod 3 is made of tungsten, and a tungsten coil 12 is wound around the head of the electrode rod 3. A supporting member (metal hook) 11 is provided at one end of the external lead 5, which supporting member 11 functions to fix the electrode structure 50 onto the inner surface of the side tube portion 2'. The supporting member 11 shown in FIG. 4 is a molybdenum tape (Mo tape) made of molybdenum, but in place of this, a ring-shaped spring made of molybdenum may be used.

Figure 9:
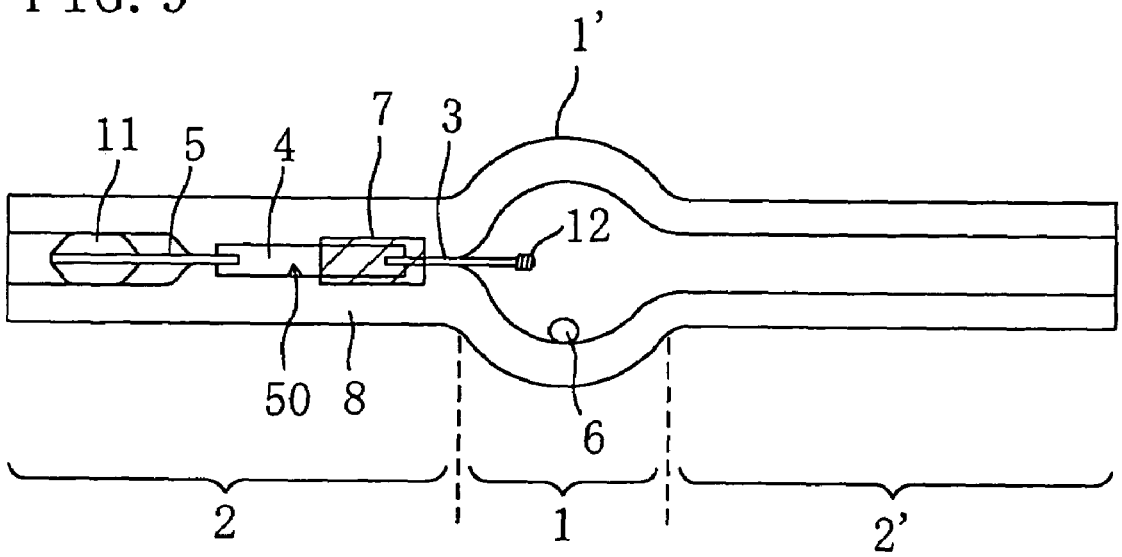
FIG. 9 is a cross-sectional view illustrating a process step in the method for manufacturing the lamp 100.

Then, the side tube portion 2' and the glass tube 170 are heated and contracted, so that the electrode structure 50 is sealed. In the process step for forming the sealing portion 2, the side tube portion 2' is heated from the boundary thereof with the luminous bulb portion 1' toward the external lead 5 by using a burner (or a $CO_2$ laser). Alternatively, this heating and contraction may be performed in the direction heading from the external lead 5 to the luminous bulb portion 1'. This heating and contraction process allows the outer tube 172 (quartz glass layer) of the compound glass tube 170 to make tight contact with the side tube portion 2' made of quartz glass, thereby obtaining the sealing portion 2 including the second glass portion 7, as shown in FIG. 9.

Figure 10:
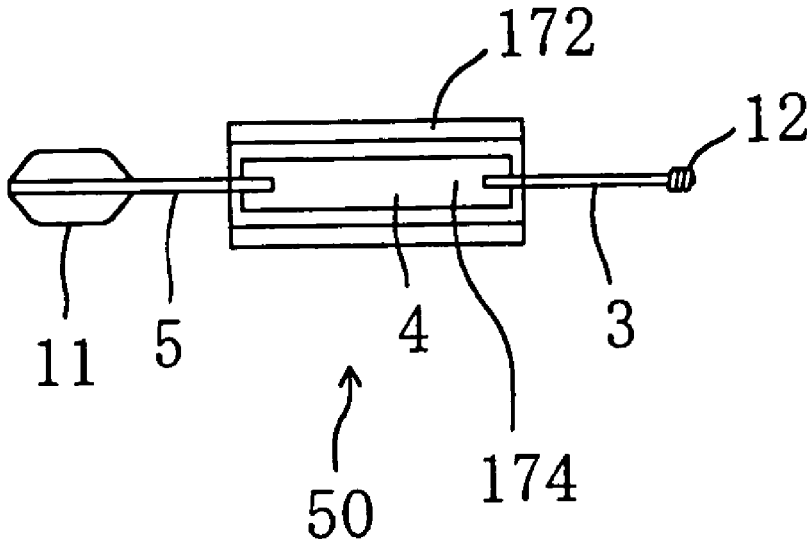
FIG. 10 is a schematic view illustrating a configuration of an electrode structure that includes glass members (172, 174).

In this embodiment, as shown in FIG. 10, it is possible to use an electrode structure 50 that includes a compound glass tube (172, 174) formed therein. In that case, a compound glass tube 170 does not have to be disposed into the side tube portion 2' to form a sealing portion 2. The sealing portion 2 can be formed by inserting into the side tube portion 2' the high-pressure discharge lamp element (the electrode structure 50 that includes the Vycor- and quart-glass layers) in which the glass members (172, 174) are tightly attached to the electrode structure 50 as shown in FIG. 10.

After one of the sealing portions 2 has been formed, a predetermined amount of mercury 6 (for example, about 200 mg/cc, about 300 mg/cc, or more than 300 mg/cc) is introduced from the end portion of the side tube portion 2' that is open. In this introduction process, a halogen precursor is also introduced. Which of the mercury 6 and the halogen precursor is introduced first is insignificant, so that they may be introduced at the same time or either of them may be introduced first.

After the mercury 6 and the halogen precursor have been introduced, the same process steps are performed for the other side tube portion 2'. Specifically, the compound glass tube 170 and the electrode structure 50 are inserted into the unsealed side tube portion 2', and then the glass pipe 80 is evacuated to a vacuum (preferably to about $10^{-4}$ Pa), a rare gas is enclosed, and heating is performed for sealing. In this embodiment, even if a gaseous halogen precursor (e.g., $CH_2Br_2$) is introduced before the sealing-portion formation process step, it is possible to prevent halogen-caused deformation occurring in the interface (boundary) between the Vycor glass layer (174) and the quartz glass layer (172) because the quartz glass layer (172) covers the Vycor glass layer (174). It should be noted that while the heating process for sealing is performed, the luminous bulb portion 1' is preferably cooled in order to prevent the mercury from evaporating.

When both sealing portions 2' have been sealed in the afore-mentioned manner, the lamp that includes the second glass portions 7 in the sealing portions 2 is completed. As mentioned in the foregoing description, the quartz glass layer (172) and the quartz glass of the side tube portion 2' are formed into one body upon the completion of the sealing-portion formation process step.

Next, the mechanism by which compressive stress is applied to the second glass portions 7 (or the vicinity of the circumferential periphery thereof) in the sealing-portion formation process will be described with reference to FIGS. 17A and 17B. This mechanism is inferred by the inventors, and therefore the true mechanism might not be like this. However, for example, as shown in FIG. 3A, it is true that compressive stress (compressive strain) is present in the second glass portions 7 (or the vicinity of the circumferential periphery thereof). It is also true that the withstand pressure is increased by the sealing portions 2 that includes such a compressive-stress applied portion.

Figure 17A:
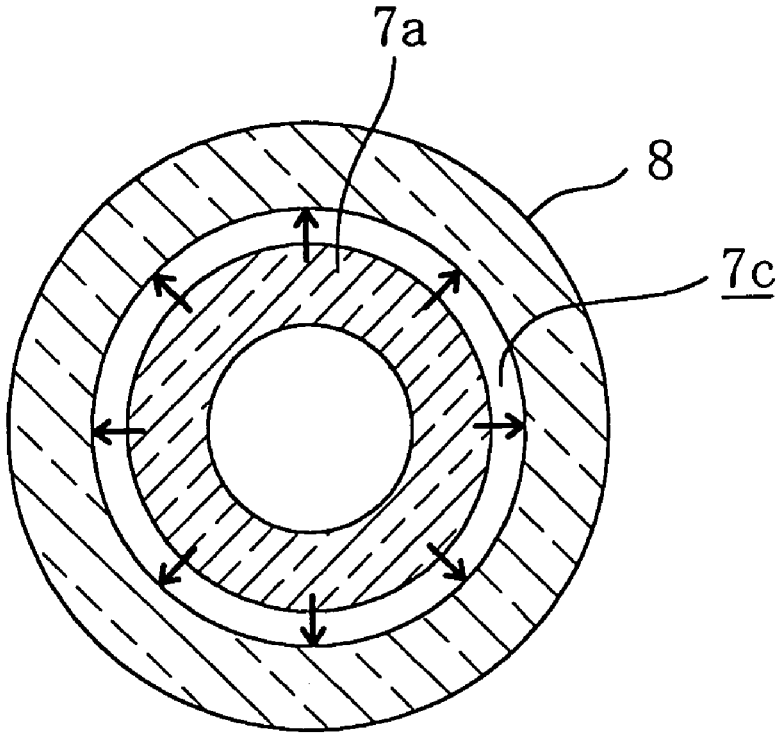
FIGS. 17A and 17B are cross-sectional views for explaining the mechanism behind creation of compressive strain in the second glass portion.
Figure 17B:
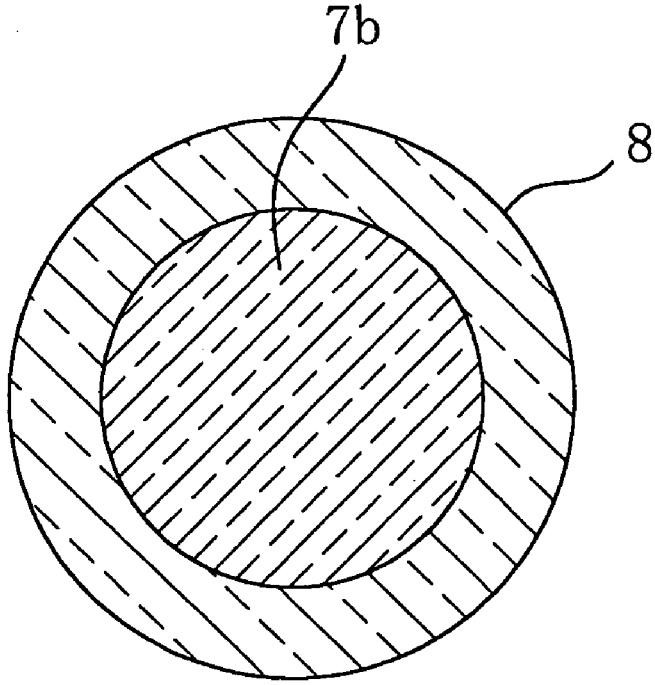

FIG. 17A is a schematic view showing a cross sectional structure obtained when a second glass portion 7*a* in the state of the glass tube 70 is inserted into a first glass portion 8 in the state of the side tube portion 2'. On the other hand, FIG. 17B is a schematic view showing a cross sectional structure obtained when the second glass portion 7*a* is softened into a molten state 7*b* in the structure of FIG. 17A. In this embodiment, the first glass portion 8 is made of quartz glass containing 99 wt % or more of $SiO_2$, while the second glass portion 7*a* is made of Vycor glass.

First, in many case, compressive stress (compressive strain) is caused by difference in thermal expansion coefficient between materials that are in contact with each other. In other words, the generally thinkable reason for the compressive stress applied to the second glass portion 7 in each sealing portion 2 may be that there is difference in thermal expansion coefficient between the two components. However, in this case, in fact, there is no large difference in thermal expansion coefficient between the two components, and their thermal expansion coefficients are substantially equal. More specifically, the thermal expansion coefficients of tungsten and molybdenum, which are metals, are about $46\times10^{-7}$/° C. and about 37 to $53\times10^{-7}$/° C., respectively. The thermal expansion coefficient of the quartz glass constituting the first glass portion 8 is about $5.5\times10^{-7}$/° C., and the thermal expansion coefficient of Vycor glass is about $7\times10^{-7}$/° C., which may be regarded to be at the same level as that of quartz glass. It does not seem possible that such a small difference in the thermal expansion coefficient causes a compressive stress of about 10 kgf/cm$^2$ or more between them. The characteristic difference between the two components lies in the softening point or the strain point rather than in the thermal expansion coefficient. When this aspect is focused on, the mechanism behind the presence of the applied compressive stress may be explained as follows. The softening point and the strain point of quartz glass are 1650° C. and 1070° C., respectively (annealing point is 1150° C.). On the other hand, the softening point and the strain point of Vycor glass are 1530° C. and 890° C., respectively (annealing point is 1020° C.).

When the first glass portion 8 (side tube portion 2') in the state shown in FIG. 17A is heated from the outside, causing the first glass portion 8 to shrink, a gap 7*c* present at first between the first and second glass portions 8 and 7*a* is filled, which allows the two components to be in contact with each other. After the first glass portion 8 has shrunk, as shown in FIG. 17B, there is a point in time when the second glass portion 7*b*, which is positioned inside the first glass portion 8 and has a lower softening point than the first glass portion 8, is still softened (in the molten state) even though at that time the first glass portion 8 that has a higher softening point and is exposed to the air in a larger area is relieved from the softened state (that is the point in time when it is solidified). The second glass portion 7*b* in this point in time is more fluid than the first glass portion 8, so that even if the thermal expansion coefficients of the two components are substantially the same in the normal state (at the time when they are not softened), it can be considered that the properties (e.g., elastic modulus, viscosity, density or the like) of the two components at this point in time are significantly different. Then, when the second glass portion 7*b* that was fluid is cooled as the time passes to the extent that the temperature of the second glass portion 7*b* falls below its softening point, the second glass portion 7 is also solidified like the first glass portion 8. If the first glass portion 8 and the second glass portion 7 had the same softening point, the two glass portions would be cooled gradually from the outside and solidified with no compressive strain remained therein. However, in the structure of this embodiment, the outer glass portion (8) is solidified earlier and then in some time later, the inner glass portion (7) is solidified. As a result, compressive strain remains in the inner second glass portion 7. Considering these points, it may be considered that the state of the second glass portion 7 is obtained as a result of performing a kind of indirect pinching.

In general, if such compressive strain remains, the difference in thermal expansion coefficient between the two components (7 and 8) will terminate the attachment state of the two components at a certain temperature. However, in this embodiment, since the thermal expansion coefficients of the two components are substantially equal, it can be presumed that the attachment state of the two components (7 and 8) can be maintained even if such compressive strain is present.

Furthermore, it was found that in order to apply a compressive stress of about 10 kgf/cm$^2$ or more to the second glass portion 7, it is necessary to heat the lamp assembled by the above-described manufacturing method (a lamp assembly) at a higher temperature than the strain point of the second glass portion. In addition, it was also found that it is preferable to heat the lamp at 1030° C. for two or longer hours. More specifically, the finished lamp 100 may be placed in a furnace at 1030° C. and annealed (i.e., baked in vacuum or baked at reduced pressure). The temperature of 1030° C. is only an example and any temperature higher than the strain point temperature of the second glass portion (Vycor glass) 7 may be adopted. That is to say, the lamp 100 may be annealed at any temperature higher than 890° C., which is the strain point temperature of Vycor. A preferable temperature is higher than the Vycor strain point temperature of 890° C. but lower than the strain point temperature of the first glass portion made of quartz glass (the strain point temperature of $SiO_2$ is 1070° C.). Nevertheless, the present inventors observed some effects in some of their experiments conducted at about 1080° C. and 1200° C.

For comparison, when a high-pressure discharge lamp that had not been annealed was measured by the sensitive color plate method, a compressive stress of about 10 kgf/cm$^2$ or more was not observed in the sealing portions, although the second glass portions 7 were provided in the sealing portions of the high-pressure discharge lamp.

The duration of the annealing (or the vacuum baking), which has to be at least two hours, does not have any particular upper limit except the ceiling viewed from an economic perspective. Any appropriate duration may be determined as long as it is two hours or longer. Furthermore, if some effect can be obtained, the heat treatment (annealing) may be performed for less than two hours. By performing the annealing process, high purity of the lamp, in other words, reduction of the impurities may have been achieved. This is presumably because the annealing of the lamp assembly can remove from the lamp the water content that is considered to adversely affect the lamp (e.g., the water content of in the Vycor). If the annealing is performed for 100 hours or more, the water content in the Vycor can be removed substantially completely from the lamp.

In the above description, an exemplary case in which the second glass portions 7 are formed of Vycor glass has been described. However, even if the second glass portions 7 are formed of a glass containing 62 wt % of $SiO_2$, 13.8 wt % of $Al_2O_3$, and 23.7 wt % of CuO (product name: SCY2 manufactured by SEMCOM Corporation: Strain point: 520° C.), the state in which compressive stress is applied at least in the longitudinal direction of the second glass portions 7 has been found to be achieved.

Next, the mechanism, which is inferred by the inventors, and by which compressive stress is applied to the second glass portions 7 of the lamp as a result of annealing performed on the lamp assembly at a predetermined temperature for a predetermined period of time or longer, will be described with reference to FIG. 18.

Figure 18A:
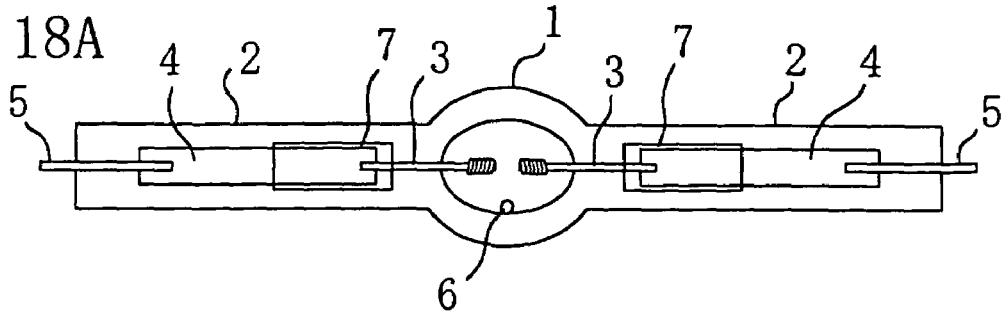
FIGS. 18A to 18D are cross-sectional views for explaining the mechanism by which compressive stress is applied by annealing.

First, as shown in FIG. 18A, a lamp assembly is prepared. The lamp assembly is manufactured in the above-described manner.

Figure 18B:
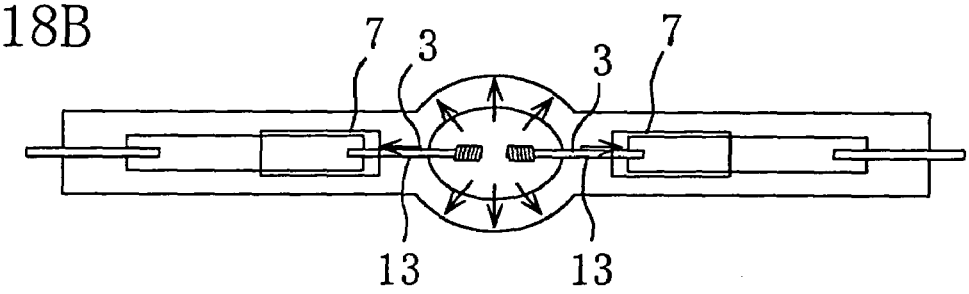

Next, when the lamp assembly is heated, as shown in FIG. 18B, mercury (Hg) 6 starts to evaporate, causing pressure to be applied to the luminous bulb 1 and to the second glass portions 7. The arrows shown in FIG. 18B indicate the pressure (e.g., 100 atm or more) created by the vapor of the mercury 6. The vapor pressure of the mercury 6 is applied not only to the inside of the luminous bulb 1 but also to the second glass portions 7, because there are gaps 13 that cannot be recognized by human eyes in the sealed portions of the electrode rods 3.

The heating temperature is further increased to exceed the strain point of the second glass portions 7 (e.g., 1030° C.), and the heating of the lamp assembly is continued at that raised temperature. This allows the vapor pressure of the mercury to be applied to the second glass portions 7 that are in a soft state, so that compressive stress is generated in the second glass portions 7. It is estimated that such compressive stress is generated in about 4 hours when the lamp is heated at the strain point, and in about 15 minutes when the lamp is heated at the annealing point, for example. These times are derived from the definitions of the strain point and the annealing point. More specifically, the strain point refers to a temperature at which if the lamp is held for 4 hours, internal strain therein is substantially removed. The annealing point refers to a temperature at which if the lamp is held for 15 minutes, internal stress therein is substantially removed. The above estimated periods of time are derived from these facts.

Figure 18C:
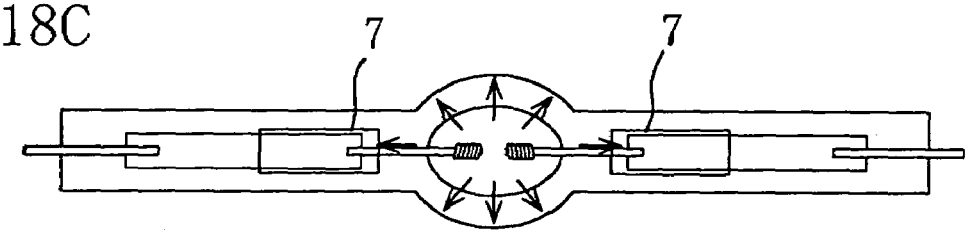
Figure 21A:
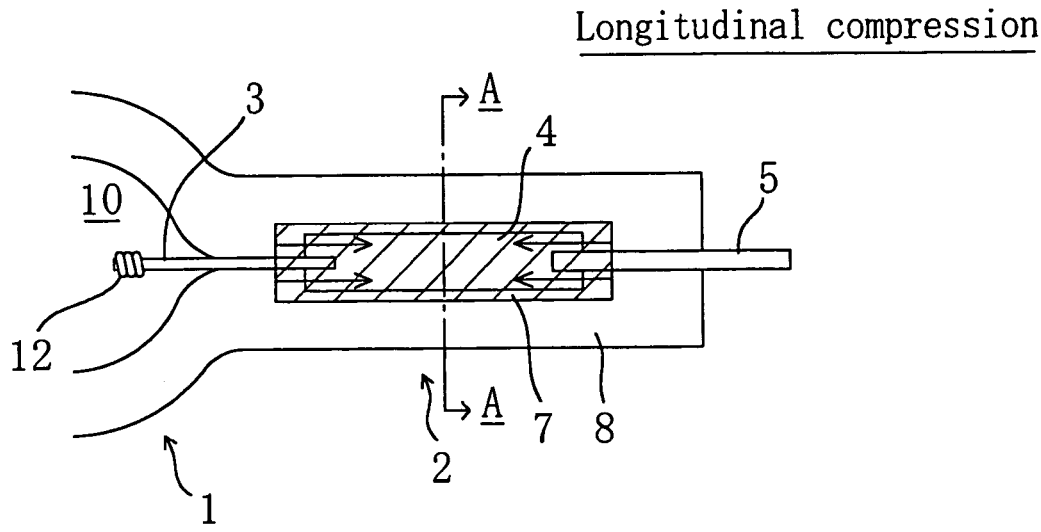
FIG. 21A is a schematic view showing compressive stress present in the longitudinal direction in the second glass portion.
Figure 21B:
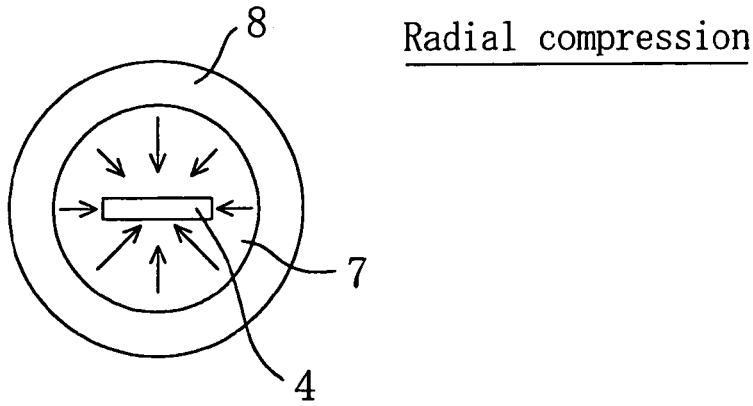
FIG. 21B is a cross-sectional view taken along the line A—A of FIG. 21A.

Next, the heating is stopped, so that the lamp assembly is cooled. Even after the heating is stopped, as shown in FIG. 18C, the mercury continues to evaporate. Therefore, while the second glass portions 7 are continuously subjected to the pressure created by the mercury vapor, the temperature of the second glass portions 7 is decreased below the strain point. Consequently, as shown in FIG. 21, the compressive stress not only in the longitudinal direction but also in the radial or other direction of each metal foil 4 remains in the second glass portion 7 (however, only the longitudinal compressive stress can be observed with the strain detector.)

Figure 18D:
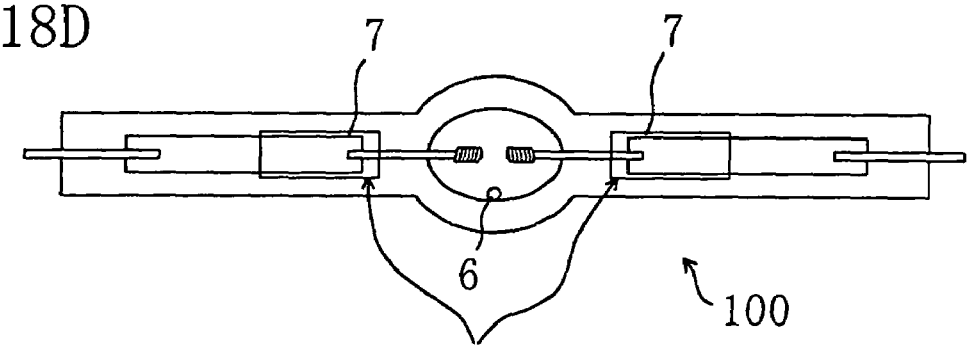

Finally, when the temperature of the lamp assembly is cooled to about room temperature, as shown in FIG. 18D, a lamp 100 in which a compressive stress of about 10 kgf/cm$^2$ or more is present in the second glass portions 7 is obtained. As shown in FIGS. 18B and 18C, the mercury vapor pressure causes pressure to be applied to both the second glass portions 7. This method thus ensures that a compressive stress of about 10 kgf/cm$^2$ or more is applied to both the sealing portions 2.

Figure 19:
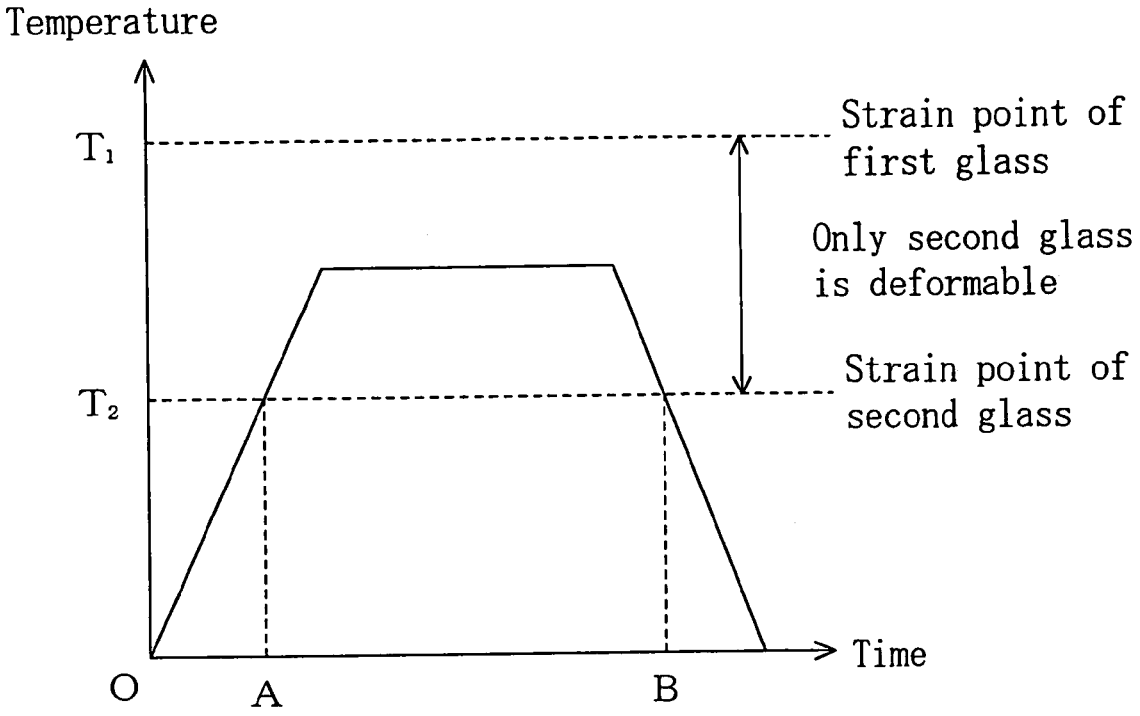
FIG. 19 is a graph schematically indicating a profile of a heating process (annealing process).
Figure 20:
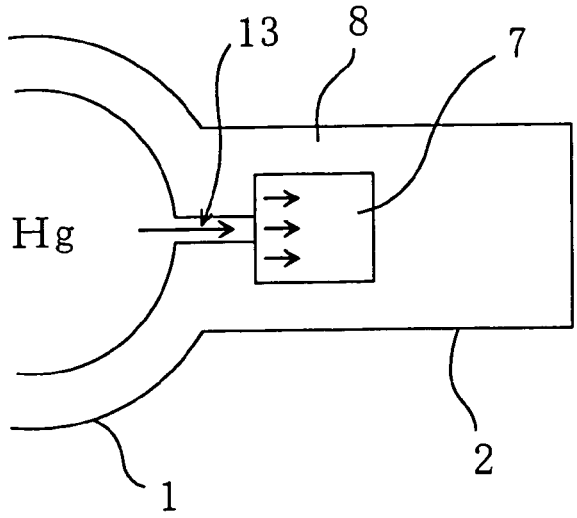
FIG. 20 is a schematic view for explaining the mechanism by which compressive stress is generated in the second glass portion by mercury vapor pressure.

FIG. 19 schematically shows the profile of this heating process. First, the heating is started (at time O), and then the temperature reaches the strain point ($T_2$) of the second glass portions 7 (at time A). Then, the lamp is held at a temperature between the strain point ($T_2$) of the second glass portions 7 and the strain point ($T_1$) of the first glass portions 8 for a predetermined period of time. This temperature range can be basically regarded as a range in which only the second glass portions 7 can be deformed. During the time that the lamp assembly is held at this temperature, compressive stress is produced in the second glass portions 7 by the mercury vapor pressure (e.g., 100 atm or more) as shown in a schematic view in FIG. 20.

It is considered that applying pressure to the second glass portions 7 by the mercury vapor pressure is the most effective way to utilize the annealing treatment. It can be inferred, however, that if some force can be applied to the second glass portions 7 while the lamp is held at a temperature in the range between $T_2$ and $T_1$ shown in FIG. 19, it is also possible that compressive stress will be generated in the second glass portions 7 due to not only the mercury vapor but also to that force (e.g., pushing the external leads 5).

Next, when the heating is stopped, the lamp is cooled so that the temperature of the second glass portions 7 becomes lower than the strain point ($T_2$) after time B. When the temperature decreases below the strain point ($T_2$), the compressive stress in the second glass portions 7 remains. In this embodiment, after the lamp has been held at 1030° C. for 150 hours, it is cooled (natural cooling). In this way, the compressive stress is generated to remain in the second glass portions 7.

By the above-described mechanism, compressive stress is generated by the mercury vapor pressure, such that the magnitude of the compressive stress depends on the mercury vapor pressure (in other words, the amount of mercury enclosed).

In general, lamps tend to break easily as the amount of mercury enclosed is increased. However, in a lamp in which the sealing structure of this embodiment is used, as the mercury amount is increased, the compressive stress and hence the withstand pressure are increased. That is to say, with the structure of this embodiment, a higher withstand pressure structure can be realized as the mercury amount is increased. Therefore, stable operation at very high withstand pressure that cannot be realized by current techniques can be realized.

According to the manufacturing method of this embodiment, the sealing portions 2 are formed by inserting into each side tube portion 2' the compound glass tube 170 that is composed of the outer tube 172 made of a first glass having a high softening point and the inner tube 174 made of a second glass having a low softening point. This prevents impurities (mainly, water) from entering between the first and second glass portions 8 and 7, thereby preventing generation of bubbles in the sealing portions 2. Furthermore, it is possible to suppress compositional alteration of the second glass portions 7, such that compressive strain is generated in the second glass portions 7 more reliably.

(Second Embodiment)

Figure 11:
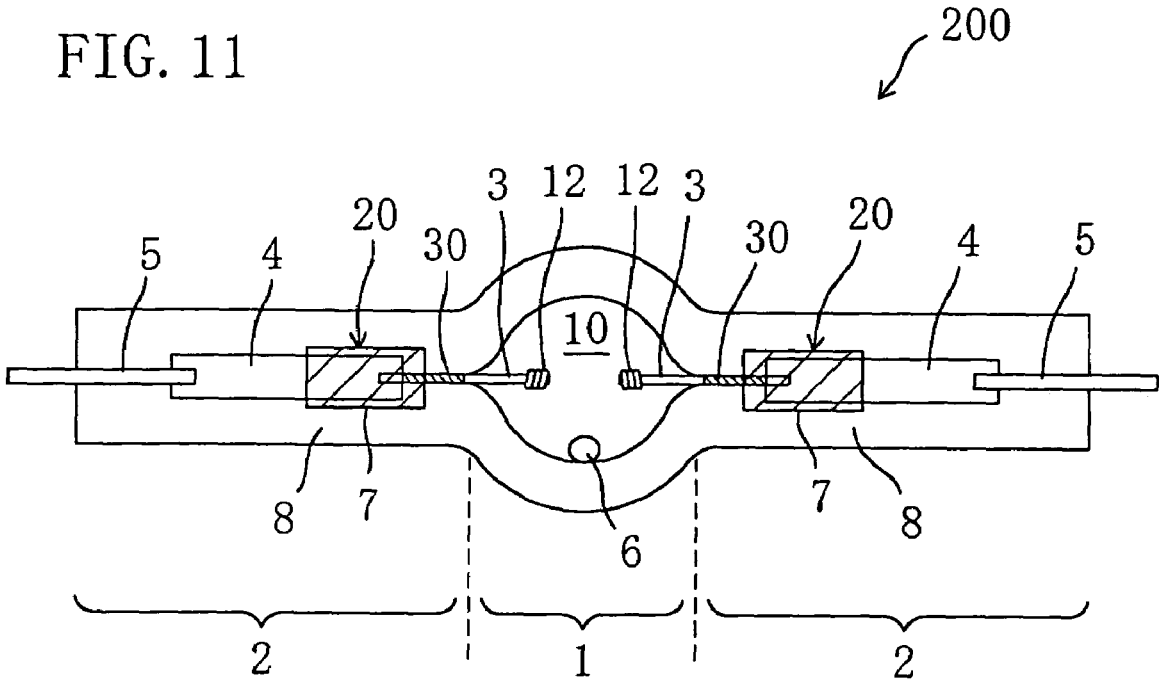
FIG. 11 is a schematic cross-sectional view showing the structure of a high-pressure discharge lamp 200 of an embodiment of the present invention.

A high-pressure discharge lamp according to a second embodiment of the present invention will be described with reference to FIG. 11. FIG. 11 is a schematic view showing the structure of a high-pressure discharge lamp 200 of this embodiment. Like the high-pressure discharge lamp 100 of the first embodiment, an electrode structure is enclosed in sealing portions 2 of the lamp 200.

In order to further improve the strength against pressure of the lamp 100 of the first embodiment, it is preferable, as in the lamp 200 shown in FIG. 11, to form a metal film (e.g., a Pt film) 30 on the surface of at least a portion of each electrode rod 3 that is buried in the sealing portion 2. The metal films 30 may be formed of at least one metal selected from the group consisting of Pt, Ir, Rh, Ru, and Re. The metal films 30 may be formed as a single layer made of a Pt layer, for example, or the metal films 30 may be formed, in view of attachment, in such manner that the lower layer is an Au layer, while the upper layer is, for example, a Pt layer.

In the lamp 200, the metal film 30 is formed on the surface of the portion of each electrode rod 3 that is buried in the sealing portion 2, so that small cracks are prevented from occurring in the glass located around the electrode rod 3. That is to say, in the lamp 200, in addition to the effects obtainable by the lamp 100, the effect of preventing cracks can be obtained. This effect further increases the strength against pressure. The effect of preventing cracks will be described further below.

In a lamp in which no metal film 30 is formed on the electrode rods 3 positioned in the sealing portions 2, cracks occur in the following manner. In the sealing-portion formation step in the lamp-manufacture process steps, the glass of each sealing portion 2 is attached to the corresponding electrode rod 3, and then detached during the cool-down stage because of difference in thermal expansion coefficient between the glass and the electrode rod 3. At this time, cracks are generated in the quartz glass around the electrode rod 3. The presence of these cracks makes the strength against pressure lower than that of an ideal lamp without cracks.

In the case of the lamp 200 shown in FIG. 11, the metal film 30 having a Pt layer as its surface layer is formed on the surface of each electrode rod 3, so that the wettability between the quartz glass of the sealing portion 2 and the surface (Pt layer) of the electrode rod 3 becomes poor. Specifically, the wettability between platinum and quartz glass is poorer than that between tungsten and quartz glass, so that platinum and quartz glass, which are not attached to each other, are easily detached from each other. Therefore, due to the poor wettability therebetween, the electrode rod 3 and the quartz glass are easily detached from each other during the cool-down stage after the heating, which prevents small cracks from being generated. The lamp 200, which is manufactured based on the technical idea that the generation of cracks is prevented by utilizing such poor wettability, exhibits higher strength against pressure than the lamp 100.

Figure 12:
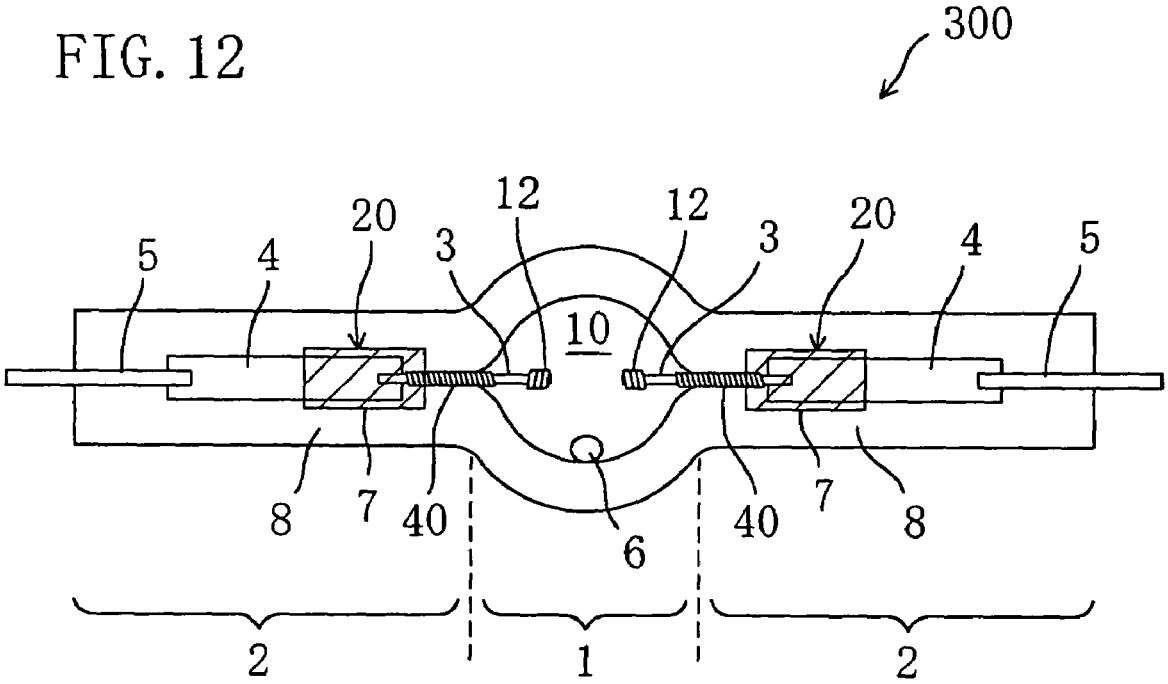
FIG. 12 is a schematic cross-sectional view showing the structure of a high-pressure discharge lamp 300 of an embodiment of the present invention.

The structure of the lamp 200 shown in FIG. 11 can be replaced by the structure of a lamp 300 shown in FIG. 12. In the lamp 300, a coil 40 whose surface is coated with the metal film 30 is wound around the surface of each electrode rod 3 where the electrode rod 3 is buried in the sealing portion 2 in the structure of the lamp 100 shown in FIG. 1. In other words, the lamp 300 has a structure in which the coil 40, having at least one metal selected from the group consisting of Pt, Ir, Rh, Ru, and Re at least on its surface, is wound around the base of each electrode rod 3. In the structure shown in FIG. 12, the coil 40 is wound up to the portion of each electrode rod 3 that is positioned in the discharge space 10 of the luminous bulb 1. Also in the structure of the lamp 300 shown in FIG. 12, the wettability between the electrode rods 3 and the quartz glasses can be made poor by the respective metal film 30 on the surface of the coils 40, so that small cracks can be prevented from being generated.

The metal on the surface of each coil 40 may be formed, for example, by plating. As in the structure shown in FIG. 11, the metal films 30 may be formed as a single layer made of a Pt layer, for example, or the metal films 30 may be formed, in view of attachment, in such manner that the lower layer is an Au layer and the upper layer is, for example, a Pt layer. It is preferable in view of attachment that an Au layer serving as the lower layer is first formed on the coils 40 and then, for example, a Pt layer acting as the upper layer is formed. However, even the coils 40 plated only with Pt instead of having the two-layered structure of the Pt (upper layer)/Au (lower layer) plating can provide practically sufficient attachment.

In the structure in which at least one metal (referred to also as "Pt or the like") selected from the group consisting of Pt, Ir, Rh, Ru, and Re is provided on the respective surfaces of the electrode rods 3 or the respective surfaces of the coils 40, the presence of the second glass portion 7 around each metal foil 4 as seen in the structures of the embodiments of the present invention is very significant. This will be further discussed below. Metal such as Pt can be evaporated to some extent by heating during processing in a lamp-manufacture process step (sealing process step). If the evaporated metal is diffused to the metal foils 4, the attachment between each metal foil and the glass is weakened, which may decrease the withstand pressure. However, as in the structure of this embodiment, if the second glass portions 7 are provided around the respective metal foils 4, and compressive strain is present in the second glass portions 7, then the poor wettability between Pt or the like and the glass is no more relevant. Consequently, such decrease in the withstand pressure caused by the diffusion of Pt or the like can be prevented. It should be noted that as compared to cases in which no coil 40 is used, even coils 40 that do not have the metal film 30 on their surface also provide the effect of preventing occurrence of cracks due to difference in thermal expansion coefficient between the electrode rods 3 and the first glass portions 8.

It is to be noted that in the structures shown in FIGS. 11 and 12, material in the solid state (at ambient temperature) such as $HgBr_2$, rather than material in the gaseous state such as $CH_2Br_2$, is preferably used as halogen to be enclosed (more specifically, as a halogen precursor). This is because metal such as Pt might be etched by gaseous halogen, as in the case of Vycor glass that reacts with halogen in the gaseous state and deteriorates when sealed.

Furthermore, the lamps 100, 200 and 300 according to the embodiments of the present invention can be formed into a lamp with a mirror or a lamp unit in combination with a reflecting mirror.

Figure 13:
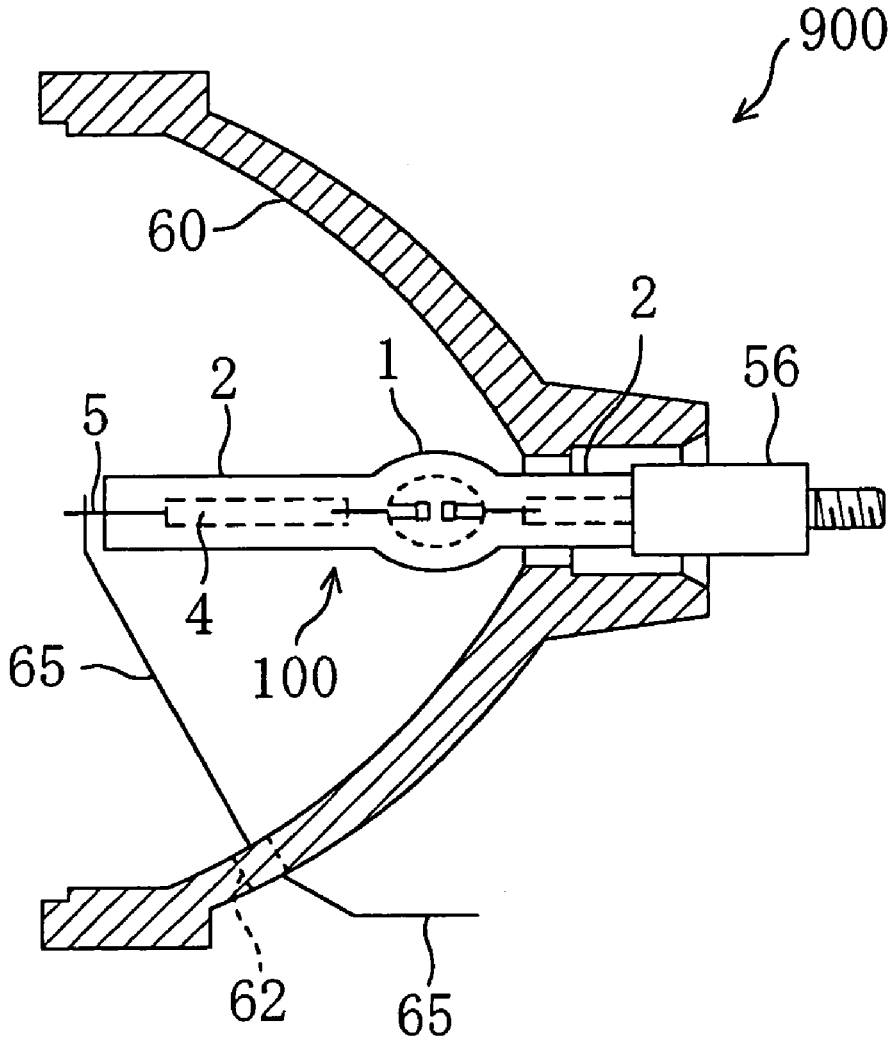
FIG. 13 is a schematic cross-sectional view showing the structure of a lamp 900 with a mirror.
Figure 14:
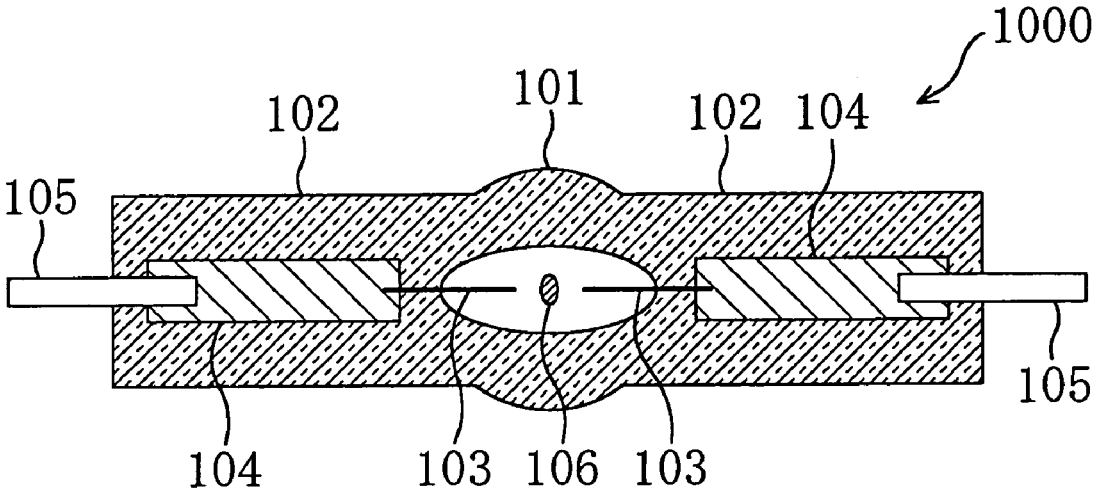
FIG. 14 PRIOR ART
FIG. 14 is a schematic cross-sectional view showing the structure of a conventional high-pressure mercury lamp.

FIG. 13 is a schematic cross-sectional view illustrating a lamp 900 with a mirror including a lamp 100 of this embodiment.

The lamp 900 with a mirror includes a lamp 100 having a substantially spherical luminous bulb 1 and a pair of sealing portions 2, and a reflecting mirror 60 for reflecting light emitted from the lamp 100. It will be appreciated that the lamp 100 is only an example, and that the lamp 200 or the lamp 300 may be used as well. The mirror-equipped lamp 900 may further include a lamp housing for holding the reflecting mirror 60. A mirror-equipped lamp including a lamp housing is encompassed in a lamp unit.

The reflecting mirror 60 is configured to reflect radiated light from the lamp 100 such that the light becomes, for example, a parallel light flux, a condensed light flux converging to a predetermined small region, or a divergent light flux equivalent to light diverged from a predetermined small region. As the reflecting mirror 60, for example, a parabolic mirror or an ellipsoidal mirror may be used.

In this embodiment, a lamp base 56 is attached to one of the sealing portions 2 of the lamp 100, and is electrically connected with the external lead (5) extending from that sealing portion 2. The sealing portion 2 and the reflecting mirror 60 are attached tightly to each other with an inorganic adherent, for example, (e.g., cement), so that they are integrated into one unit. The external lead 5 of the other sealing portion 2 positioned on the front opening side of the reflecting mirror 60 is electrically connected to an extending lead wire 65. The extending lead wire 65 extends from the lead wire 5 to the outside of the reflecting mirror 60 through an opening 62 for the lead wire formed in the reflecting mirror 60. For example, a front glass may be provided in the front opening of the reflecting mirror 60.

Such a lamp with a mirror or a lamp unit may be installed as the light source in image projecting apparatuses such as projectors employing liquid crystal or DMDs (Digital Micromirror Devices). Furthermore, such a mirror-equipped lamp or a lamp unit may be combined with an optical system that includes an image device (such as a DMD panel or a liquid crystal panel) to form an image projecting apparatus. For example, projectors (digital light processing (DLP) projectors) using DMDs, and liquid crystal projectors (including reflective projectors using a LCOS (Liquid Crystal on Silicon) structure) can be provided. Furthermore, the lamps, mirror-equipped lamps and lamp units in accordance with this embodiment may be used not only as a light source for an image projecting apparatus but also for other applications such as a light source for an ultraviolet ray stepper, a light source for a sport stadium, a light source for an automobile headlight, and a light source for a floodlight for illuminating a traffic sign.

(Other Embodiments)

In the above embodiments, mercury lamps using mercury as luminous material have been described as exemplary high-pressure discharge lamps, but the present invention may be applied to any high-pressure discharge lamps having the structure in which the sealing portions (seal portions) maintain the airtightness of the luminous bulb. For example, the present invention is applicable to high-pressure discharge lamps such as metal halide lamps in which a metal halide is enclosed, and xenon lamps. This is because also in metal halide lamps or the like, the more the withstand voltage is increased the better. That is to say, a highly reliable, long-life lamp can be achieved by preventing leakage or cracks. Moreover, if the structures of the foregoing embodiments are applied to metal halide lamps in which not only mercury but also a metal halide is enclosed, the following effects can be obtained. The attachment of the metal foils 4 in the sealing portions 2 can be improved by providing the second glass portions 7, so that reaction between the metal foils 4 and the metal halide (or halogen or an alkali metal) can be suppressed. This results in an improvement in the reliability of the structure of the sealing portions. In particular, in the case where the second glass portion 7 is positioned around a part of each metal rod 3 as in the structures shown in FIGS. 1, 6, 11 and 12 the second glass portion 7 can effectively reduce metal halide penetration which occurs from a small gap between the metal rod 3 and the glass of the sealing portion 2, and which causes embrittlement of the metal foil 4 due to the reaction of the meta foil 4 with the metal halide. Thus, the structures of the above embodiments can be applied preferably to metal halide lamps.

In recent years, mercury-free metal halide lamps in which no mercury is enclosed have been under development, and the techniques of the above embodiments are also applicable to such mercury-free metal halide lamps. This will be described in further detail below.

In mercury-free metal halide lamps to which the techniques of the above embodiments are applied, substantially no mercury but at least a first halide, a second halide and a rare gas are enclosed in the luminous bulb 1 in the structure shown in FIG. 1, 6, 8 or 9. In such lamps, the metal constituting the first halide is a luminous material. The second halide, which has a vapor pressure higher than that of the first halide, is a halide of one or more metals that emit light in the visible region with more difficulty than the metal constituting the first halide. For example, the first halide is a halide of one or more metals selected from the group consisting of sodium, scandium, and rare earth metals. The second halide has a relatively larger vapor pressure and is a halide of one or more metals that emit light in the visible region with more difficulty than the metal constituting the first halide. More specifically, the second halide is a halide of at least one metal selected from the group consisting of Mg, Fe, Co, Cr, Zn, Ni, Mn, Al, Sb, Be, Re, Ga, Ti, Zr, and Hf. The second halide preferably contains at least Zn halide.

Another exemplary combination is as follows. In a mercury-free metal halide lamp including a translucent luminous bulb (airtight vessel) 1, a pair of electrodes 3 provided in the luminous bulb 1, and a pair of sealing portions 2 coupled to the luminous bulb 1, $SCI_3$ (scandium iodide) and NaI (sodium iodide) as luminous materials, $InI_3$ (indium iodide) and TlI (thallium iodide) as alternative materials to mercury, and a rare gas (e.g., Xe gas at 1.4 MPa) as a starting aid gas are enclosed in the luminous bulb 1. In this case, $ScI_3$ (scandium iodide) and NaI (sodium iodide) constitute the first halide, while $InI_3$ (indium iodide) and TlI (thallium iodide) constitute the second halide. The second halide may be any halide as long as it has a comparatively high vapor pressure and can serve as an alternative to mercury. Therefore, for example, Zn iodide may be used instead of $InI_3$ (indium iodide).

The reason why the technique of the first embodiment can be applied preferably to such a mercury-free metal halide lamp will be described below.

First, the efficiency of a mercury-free metal halide lamp, in which an alternative substance to Hg (for example, Zn halide) is employed, is lower than that of a lamp containing mercury. In order to increase the efficiency, it is very advantageous to increase the light operating pressure of the mercury-free metal halide lamp. The lamps of the above-mentioned embodiments have a structure that improves the withstand pressure, so that a rare gas can be enclosed to a high pressure, which permits the efficiency to be increased easily. Therefore, if an alternative substance to mercury is enclosed in those inventive lamps, practically usable mercury-free metal halide lamps can be realized easily. In that case, Xe having a low thermal conductivity is preferable as the rare gas.

In the case of a mercury-free metal halide lamp, since mercury is not enclosed therein, it is necessary to enclose halogen in a larger amount than in the case of a metal halide lamp containing mercury. Therefore, the amount of halogen that reaches the metal foils 4 through gaps near the electrode rods 3 is also increased, and the halogen reacts with the metal foils 4 (or the respective base portion of the electrode rods 3 in some cases). As a result, the sealing portion structures become weak so that leakage tends to occur. In the structures shown in FIGS. 11 and 12, the surface of each electrode rod 3 is coated with the metal film 30 (or the coil 40), which effectively prevents such reaction between the electrode rod 3 and the halogen. As shown in FIG. 1, for example, in the case of the structure in which the second glass portions 7 are positioned around the respective electrode rods 3, the second glass portions 7 prevent penetration of the halide (e.g., Sc halide) and hence occurrence of leakage. Therefore, mercury-free metal halide lamps having the structures of the above-described embodiments exhibit a higher efficiency and a longer life than conventional mercury-free metal halide lamps. This holds true widely for lamps for general illumination. For lamps used for automobile headlights, the following advantage can also be provided.

In the case of automobile headlights, light of almost 100% intensity must be provided at the moment the switch is turned on. In order to meet this demand, it is effective to enclose a rare gas (specifically, Xe) to a high pressure. However, if Xe is enclosed to a high pressure in an ordinary metal halide lamp, the possibility of rupture increases. This is disadvantageous for a lamp used in a headlight, in which a higher degree of safety should be secured. Specifically, the malfunction of a headlight at night leads to a car accident. Mercury-free metal halide lamps having the structures of the above embodiments have an improved withstand pressure, so that even if Xe is enclosed to such a high pressure, the operation-start properties of those lamp are improved, while their safety is maintained. In addition, since those lamps also attain a longer life, they are applicable in headlights more suitably.

Furthermore, in the above embodiments, the case where the mercury vapor pressure of the lamps is about 20 MPa or 30 MPa or more (the case of a so-called ultrahigh-pressure mercury lamp) has been described, but as mentioned above, this does not eliminate the application of the foregoing embodiments to high-pressure mercury lamps having a mercury vapor pressure of about 1 MPa. The present invention may be applied to general high-pressure discharge lamps including ultrahigh-pressure mercury lamps and high-pressure mercury lamps. It should be noted that the mercury vapor pressures of lamps currently called ultrahigh-pressure mercury lamps are 15 MPa or more (the amount of mercury enclosed is 150 mg/cc or more).

The fact that a lamp is capable of operating stably at a very high operating pressure means that the reliability of the lamp is high. Therefore, when the structures of the foregoing embodiments are applied to lamps whose operating pressure is not very high (the operating pressure of the lamps is less than about 30 MPa, e.g., from about 20 MPa to 1 MPa), the reliability of the lamps operating at that operating pressure can be improved.

A technical significance of a lamp that can realize a high strength against pressure will be further described below. In recent years, in order to obtain high-pressure mercury lamps of high output and high power, short arc mercury lamps having a short arc length (interelectrode distance) (e.g., the interelectrode distance is 2 mm or less) have been under development. In the case of the short arc lamps, more mercury has to be enclosed than usual in order to suppress rapid vaporization of the electrodes associated with increases in current. As described above, in the conventional structure, there was the upper limitation on the strength against pressure, so that there was also the upper limitation on the amount of mercury to be enclosed (e.g., about 200 mg/cc or less). Those limitations have restricted realization of lamps exhibiting better characteristics. The lamps of the present invention, however, can eliminate those conventionally existing limitations to promote the development of lamps exhibiting excellent characteristics that could not be realized in the past. In the lamps of the present invention, it is possible to enclose mercury in an amount of more than about 200 mg/cc or about 300 mg/cc or more.

As described above, the technology that enables mercury to be enclosed in an amount of about 300 to 400 mg/cc or more (the operating pressure is from 30 to 40 MPa) has also significance in that the safety and reliability of lamps, particularly, lamps whose operating pressure exceeds 20 MPa (that is, lamps having an operating pressure exceeding a currently-used pressure of 15 to 20 MPa, for example lamps with an operating pressure of 23 MPa or more or 25 MPa or more) can be guaranteed. In the case of mass production of lamps, it is inevitable that there are variations in the characteristics of the resultant lamps. Therefore, even for lamps having a light operating pressure of about 23 MPa, their withstand pressure has to be secured with consideration given to the margin. In this respect, the technology that can achieve a withstand pressure of 30 MPa or more also provides a great advantage to such lamps having a withstand pressure of less than 30 MPa from the viewpoint that the products can be actually supplied. It will be appreciated that if lamps that require a withstand pressure of 23 MPa or even lower are manufactured using the technology that can achieve a withstand pressure of 30 MPa or higher, the safety and the reliability of those lamps can be improved.

Therefore, the structures of the present invention can also improve characteristics of lamps in terms of their reliability. In the lamps of the foregoing embodiments, the sealing portions 2 are formed by a shrinking technique, but they may be formed by a pinching technique. Also, double-end high-pressure discharge lamps have been described, but the techniques of the present invention can be applied to single-end discharge lamps. In the above embodiments, the second glass portions 7 are formed from the glass tubes (70) made of Vycor glass, for example, but they do not necessarily have to be formed from glass tubes. So long as the second glass portions 7 are glass structures that are in contact with the metal foils 4 to cause compressive stress to occur in parts of the sealing portions 2, the second glass portions 7 are not limited to the structure in which the second glass portions 7 cover the respective entire peripheries of the metal foils 4, that is, the second glass portions 7 are not limited to glass tubes. For example, a C-shaped glass structure that has a slit in a portion of the glass tube 70 may be used, or carats (glass pieces or glass plates) made of Vycor glass may be disposed in contact with one side or both sides of the metal foils 4. Alternatively, for example, a glass fiber made of Vycor glass may be disposed to cover the respective periphery of the metal foils 4. However, when a sintered glass material formed by compressing and sintering glass powder, for example, is used instead of the glass structure, compressive stress is not generated in part of the sealing portions 2. Therefore, it is better not to use glass powder.

In addition, the distance (arc length) between the pair of electrodes 3 may be a distance of short arc lamps, or may be longer than that. The lamps of the foregoing embodiments can be used as either of an alternating current operation type and a direct current operation type. Furthermore, the features of the structures described in the above embodiments and the modified examples can be used in any combinations. Although the sealing-portion structure that includes the metal foils 4 has been described, it is possible to apply the structures of the foregoing embodiments to sealing-portion structures in which no foil is used. In such sealing-portion structures including no foil, it is also important to increase the withstand pressure and the reliability. More specifically, a sealing-portion structure in which no foil is used may be constructed as follows. An electrode structure, which includes a single electrode rod (tungsten rod) 3 but no molybdenum foil 4, is used as an electrode structure 50. A second glass portion 7 is disposed at least on a portion of that electrode rod 3, and a first glass portion 8 is formed to cover the second glass portion 7 and the electrode rod 3. In the case of this structure, an external lead 5 can also be formed out of the electrode rod 3.

In the above-described embodiments, discharge lamps have been described, but the technique of the first embodiment is not limited to the discharge lamps, but may be applied to any lamps (e.g., incandescent lamps) other than discharge lamps as long as they have a structure in which the airtightness of the luminous bulb is maintained by the sealing portions (seal portions).

Examples of the incandescent lamps to which the inventive techniques are applicable include double-end incandescent lamps (e.g., halogen incandescent lamps), in which a filament is provided in the luminous bulb 1 between the heads of electrodes rods 3 serving as inner leads (internal lead wires) in the structure shown in FIG. 1, for example. An anchor may be provided in the luminous bulb 1. Moreover, the inventive techniques may be applied to single-end incandescent lamps. For such halogen incandescent lamps as well, since rapture is a very important issue to be addressed, the techniques of the above-described embodiments that prevent rapture has a large technical significance.

While the present invention has been shown in several forms as described in the preferable embodiments thereof, it is not so limited but susceptible of various changes and modifications.

According to the present invention, compound glass tubes, each composed of an outer tube made of a first glass and an inner tube made of a second glass, are inserted into respective side tube portions that are also made of the first glass. The second glass has a lower softening point than that of the first glass. The side tube portions are then heated, tightly attaching the side tube portions to the compound glass tubes. Thereafter, portions including at least the compound glass tubes and the side tube portions are heated at a temperature higher than the strain point temperature of the second glass. In this manner, a high-pressure discharge lamp capable of withstanding high pressures can be manufactured more effectively.

What is claimed is:

1. A method for manufacturing a high-pressure discharge lamp comprising a luminous bulb, in which a luminous substance is enclosed, and a sealing portion for retaining the airtighiness of the luminous bulb, the method comprising the steps of:

(a) preparing a glass pipe designed for use in a discharge lamp, which pipe includes a luminous bulb portion that will be formed into the luminous bulb of the high-pressure discharge lamp, and a side tube portion extending from the luminous bulb portion; and (b) forming the sealing portion from the side tube portion, wherein the sealing-portion formation step (b) includes the steps of:

(c) preparing a compound glass tube that includes an outer tube made of a first glass and an inner tube made of a second glass, the outer tube being located in tight contact with the periphery of the inner tube, the second glass having a lower softening point than that of the first glass, the side tube portion being formed of the first glass;

(d) inserting the compound glass tube into the side tube portion, and then heating the side tube portion, thereby tightly attaching the side tube portion to the compound glass tube; and (e) heating, after the attachment step (d), a portion including at least the compound glass tube and the side tube portion at a temperature higher than the strain point temperature of the second glass.

2. The method of claim 1, wherein the compound glass tube preparation step (c) includes:

inserting the inner tube made of the second glass into the outer tube made of the first glass, and reducing pressure in a gap between the outer and inner tubes, and heating at least the outer tube, thereby bringing the outer and inner tubes in tight contact with each other.

3. The method of claim 1, wherein the heating step (e) is performed at a temperature lower than the strain point temperature of the first glass.

4. The method of claim 1, wherein the outer and inner tubes form the compound glass tube;

the first glass forming the outer tube contains 99 wt % or more of SiO2; and the second glass forming the inner tube contains SiO2 and at least one of 15 wt % or less of Al2O3 and 4 wt % or less of B.

5. The method of claim 1, wherein the inner tube of the compound glass tube has a multilayer structure, while the outer tube thereof is composed of a single layer;

the outer tube is made of quartz glass; and at least one of the multiple layers forming the inner tube is a glass layer made of glass which contains SiO2 and at least one of 15 wt % or less of Al2O3 and 4 wt % or less of B.

6. The method of claim 1, wherein the heating step (e) is performed for 2 hours or more.

7. The method of claim 6, wherein the heating step (e) is performed for 100 hours or more.

8. The method of claim 1, wherein the heating step (e) is performed so that when the sealing portion is measured by a sensitive color plate method utilizing a photoelastic effect, a compressive stress of from 10 kgf/cm2 to 50 kgf/cm2 inclusive extending in the longitudinal direction of the side tube portion is present in the region formed of the second glass.

9. A method for manufacturing a high-pressure discharge lamp comprising a luminous bulb, in which a luminous substance is enclosed, and a pair of sealing portions extending from both ends of the luminous bulb, the method comprising the steps of:

(a) preparing a glass pipe designed for use in a discharge lamp, which pipe includes a luminous bulb portion that will be formed into the luminous bulb of the high-pressure discharge lamp, and a pair of side tube portions extending from both ends of the luminous bulb portion; and (b) inserting, into one of the pair of side tube portions, a compound glass tube and an electrode structure that includes at least an electrode rod, and then heating said one side tube portion to cause said one side tube portion to shrink, thereby forming one of the pair of sealing portions, wherein the compound glass tube includes an outer tube made of a first glass and an inner tube made of a second glass, the outer tube being located in tight contact with the periphery of the inner tube, the second glass having a lower softening point than that of the first glass, the side tube portions being formed of the first glass.

10. The method of claim 9, further comprising the steps of:

(c) introducing a luminous substance into the luminous bulb portion, after said one sealing portion has been formed;

(d) inserting, after said one sealing portion has been formed, a compound glass tube and an electrode structure that includes at least an electrode rod, into the other of the pair of side tube portions, and then heating said other side tube portion to cause said other side tube portion to shrink, thereby forming the other of the pair of sealing portions, wherein the compound glass tube includes an outer tube made of a first glass and an inner tube made of a second glass, the outer tube being located in tight contact with the periphery of the inner tube, the second glass having a lower softening point than that of the first glass, the side tube portions being formed of the first glass; and (e) heating the resultant lamp assembly, in which both the sealing portions and the luminous bulb have been formed, at a temperature higher than the strain point temperature of the second glass but lower than the strain point temperature of the first glass, where the lamp assembly includes at least the compound glass tubes and the side tube portions.

11. The method of claim 10, wherein the heating step (e) is performed for 2 hours or more.

12. The method of claim 11, wherein the heating step (e) is performed for 100 hours or more.

13. The method of claim 10, wherein the heating step (e) is performed so that when the sealing portions are measured by a sensitive color plate method utilizing a photoelastic effect, a compressive stress of from 10 kgf/cm2 to 50 kgf/cm2 inclusive extending in each said sealing portion in the longitudinal direction of the side tube portion is present in the region formed of the second glass.

14. The method of claim 13, wherein the compressive stress is generated in each of the pair of sealing portions.

15. The method of claim 10, wherein the high-pressure discharge lamp is a high-pressure mercury lamp, and mercury serving as the luminous substance is enclosed in an amount of 150 mg/cm3 or more, which is determined based on the internal volume of the luminous bulb.

16. The method of claim 9, wherein the compound glass tube and the electrode structure are formed into one body.

17. The method of claim 9, wherein the electrode structure includes the electrode rod, a metal foil connected to the electrode rod, and an external lead connected to the metal foil; and the compound glass tube is inserted into the side tube portion so that the compound glass tube covers at least the connection portion of the electrode rod and the metal foil.

18. The method of claim 9, wherein the first glass contains 99 wt % or more of SiO2, and the second glass contains SiO2 and at least one of 15 wt % or less of Al2O3 and 4 wt % or less of B.

* * * * *